US008577245B2

(12) United States Patent
Awano et al.

(10) Patent No.: US 8,577,245 B2
(45) Date of Patent: Nov. 5, 2013

(54) IMAGE FORMING APPARATUS

(75) Inventors: Toyohiko Awano, Kanagawa (JP); Atsuna Saiki, Kanagawa (JP); Yosuke Ninomiya, Kanagawa (JP); Kazuhiro Saito, Kanagawa (JP); Satoru Hori, Kanagawa (JP); Kiyoshi Sakoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 275 days.

(21) Appl. No.: 13/040,046

(22) Filed: Mar. 3, 2011

(65) Prior Publication Data

US 2012/0076526 A1 Mar. 29, 2012

(30) Foreign Application Priority Data

Sep. 27, 2010 (JP) ..... 2010-215951

(51) Int. Cl.
*G03G 15/04* (2006.01)

(52) U.S. Cl.
USPC ..... 399/91; 399/119

(58) Field of Classification Search
USPC ..... 399/91, 252, 279, 111, 119
See application file for complete search history.

(56) References Cited

U.S. PATENT DOCUMENTS 5,848,329 A * 12/1998 Aoyama et al. ..... 399/113
5,995,782 A * 11/1999 Isobe et al. ..... 399/119
6,496,669 B2 * 12/2002 Sato et al. ..... 399/103
7,630,661 B2 * 12/2009 Noda et al. ..... 399/67
2005/0220481 A1 * 10/2005 Yamaguchi et al. ..... 399/111
2007/0041747 A1 * 2/2007 Kim et al. ..... 399/222
2011/0318052 A1 * 12/2011 Shirayanagi ..... 399/111
2012/0076526 A1 * 3/2012 Awano et al. ..... 399/91

FOREIGN PATENT DOCUMENTS

JP 2004-233492 A 8/2004
JP 2010-191086 A 9/2010

* cited by examiner

*Primary Examiner* — David Gray
*Assistant Examiner* — Carla Therrien
(74) *Attorney, Agent, or Firm* — Sughrue Mion, PLLC

(57) ABSTRACT

An image forming apparatus includes an image bearing member rotatably supported in a body of the image forming apparatus, and bearing a developer image; a developing device including a developing container, a developing member, and a transporting member, the developing container containing a developer, the developing member disposed so as to oppose the image bearing member, the developing member having thereon the developer in the developing container and rotating to develop a latent image, the transporting member transporting the developer in the developing container while stirring the developer, the developing device being unremovably supported with respect to the body of the image forming apparatus; and a damping member disposed with respect to an axial direction of a rotational axis of the developing member so as to be situated at an end portion of the developing container in the axial direction, and restraining vibration of the developing container.

6 Claims, 26 Drawing Sheets

IMAGE FORMING APPARATUS

CROSS-REFERENCE TO RELATED APPLICATIONS

This application is based on and claims priority under 35 USC 119 from Japanese Patent Application No. 2010-215951 filed Sep. 27, 2010.

BACKGROUND

Technical Field

The present invention relates to an image forming apparatus.

SUMMARY

According to an aspect of the invention, there is provided an image forming apparatus including an image bearing member rotatably supported in a body of the image forming apparatus, the image bearing member bearing a developer image on a surface thereof; a developing device including a developing container, a developing member, and a transporting member, the developing container containing a developer, the developing member disposed so as to oppose the image bearing member, the developing member having thereon the developer in the developing container and rotating to develop a latent image formed on the surface of the image bearing member, the transporting member transporting the developer in the developing container while stirring the developer, the developing device being unremovably supported with respect to the body of the image forming apparatus; and a damping member disposed with respect to an axial direction of a rotational axis of the developing member so as to be situated at an end portion of the developing container in the axial direction, the damping member restraining vibration of the developing container.

BRIEF DESCRIPTION OF THE DRAWINGS

Exemplary embodiments of the present invention will be described in detail based on the following figures, wherein.

DETAILED DESCRIPTION

Next, exemplary embodiments will be described as specific exemplary embodiments according to the present invention. However, the present invention is not limited to the following exemplary embodiments.

To make it easier to understand the following description, in the figures, the front-back directions correspond to X-axis directions, the left-right directions correspond to Y-axis directions, and the up-down directions correspond to Z-axis directions, with the directions (sides) represented by arrows X, −X, Y, −Y, Z, and −Z corresponding to the forward direction (front side), the backward direction (back side), the rightward direction (right side), the leftward direction (left side), the upper direction (upper side), and the lower direction (lower side), respectively.

In the figures, a circle with a dot therein means that the arrow extends from the back to the front in a sheet plane, and a circle with an x therein means that the arrow extends from the front to the back in a sheet plane.

In the description below using the figures, for the sake of easier understanding, depending upon the circumstances, members other than those required for the description will not be shown.

First Exemplary Embodiment

Figure 1:
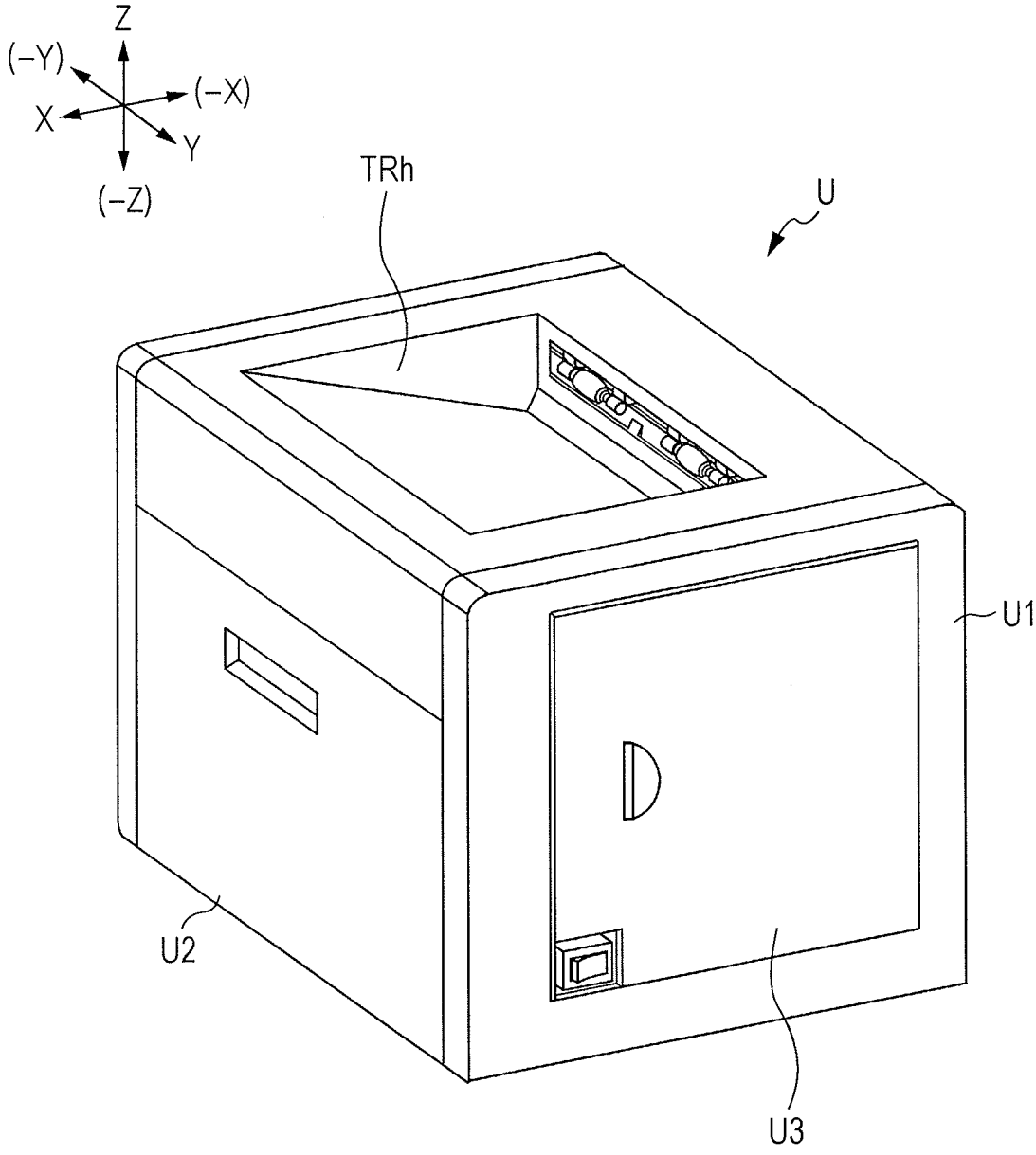
FIG. 1 is a perspective view of the entire printer according to a first exemplary embodiment of the present invention.

FIG. 1 is a perspective view of the entire printer U according to a first exemplary embodiment of the present invention.

Figure 2:
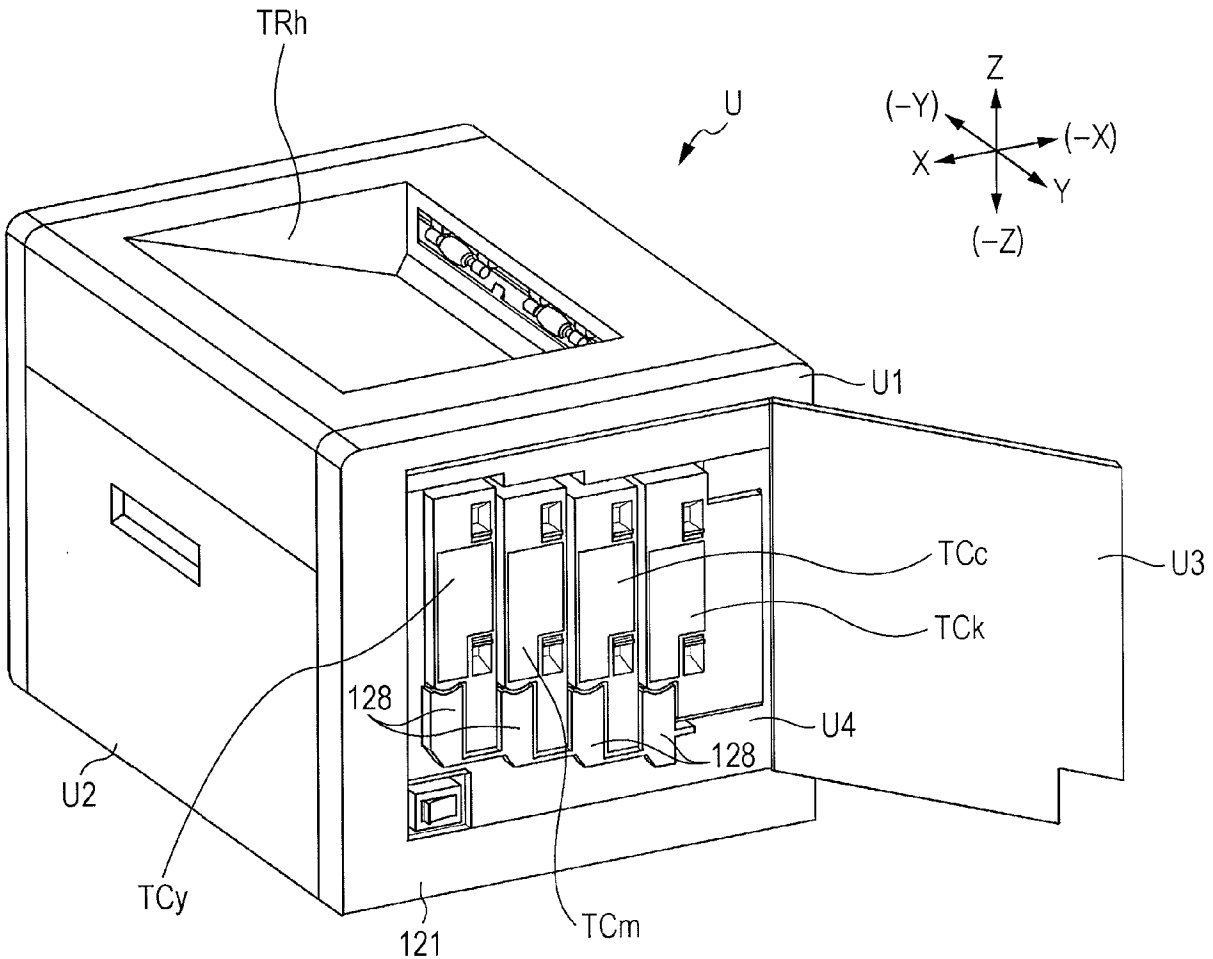
FIG. 2 illustrates the printer according to the first exemplary embodiment of the present invention, with a side cover being open.

FIG. 2 illustrates the printer U according to the first exemplary embodiment of the present invention, with a side cover U3 being open.

In FIG. 1, the printer U serving as an example of an image forming apparatus according to the first exemplary embodiment of the present invention has a printer body U1 serving as an exemplary body of the image forming apparatus. A front cover U2 serving as an exemplary medium replenishment opening-and-closing member that is opened and closed when a new medium is replenished is supported at the front side of the printer body U1. The front cover U2 is supported so as to be capable of being opened and closed with its lower end serving as the center. A discharge tray TRh serving as an exemplary discharge section to which a sheet S (serving as an exemplary medium) is discharged is provided at the top side of the printer body U1.

Figure 3:
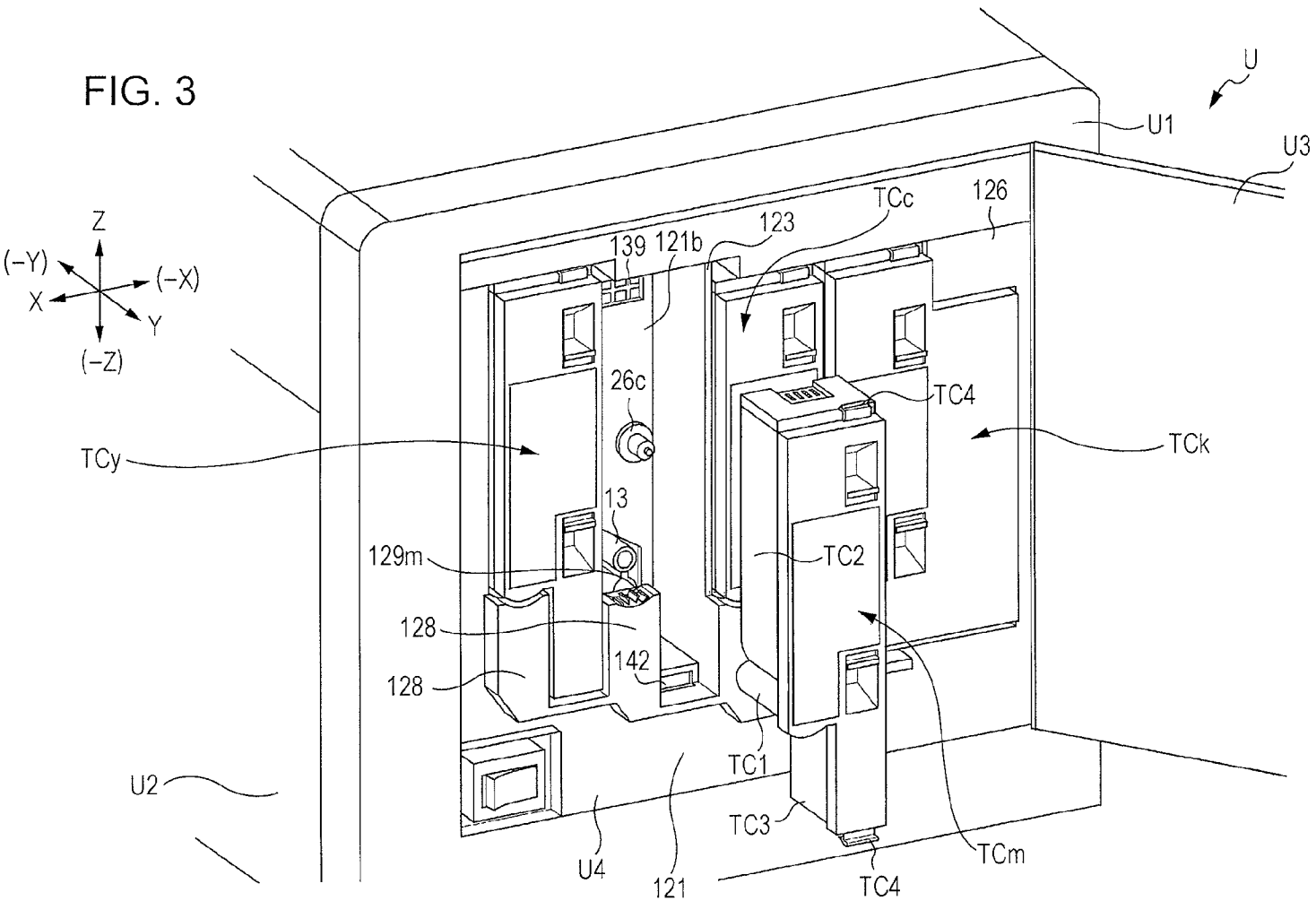
FIG. 3 illustrates a state in which a toner cartridge is removed from the printer according to the first exemplary embodiment.

FIG. 3 illustrates a state in which a toner cartridge is removed from the printer according to the first exemplary embodiment.

In FIGS. 1 and 2, the side cover U3 serving as an exemplary container replacement opening-and-closing member that is opened and closed when replacing the toner cartridge is supported at the right side of the printer body U1. The toner cartridge is an exemplary replacement container used for collecting a waste developer or used when a new developer is replenished. The side cover U3 is supported so as to be capable of being opened and closed with its back end as the center.

In FIGS. 2 and 3, a cartridge mounting/removing section U4 serving as an exemplary container mounting/removing section is formed at the printer body U1 so as to be provided at the inner side of the side cover U3. The cartridge mounting/removing section U4 supports toner cartridges TCy to TCk (serving as exemplary developer containers) so that the toner cartridges TCy to TCk are capable of being mounted to and removed from the cartridge mounting/removing section U4. The cartridge mounting/removing section U4 accommodates the four toner cartridges TCy to TCk stepwise so that one is disposed lower than another in the backward direction. In the first exemplary embodiment, the backmost black toner cartridge TCk is formed so as to have a larger capacity than those of the toner cartridges TCy, TCm, and TCc for the other colors. Accordingly, the cartridge mounting/removing section U4 is formed so that a space that accommodates the black toner cartridge TCk has a larger length in the up-down direction and a larger length in the front-back direction than spaces that accommodate the toner cartridges TCy, TCm, and TCc for the other colors.

Figure 4:
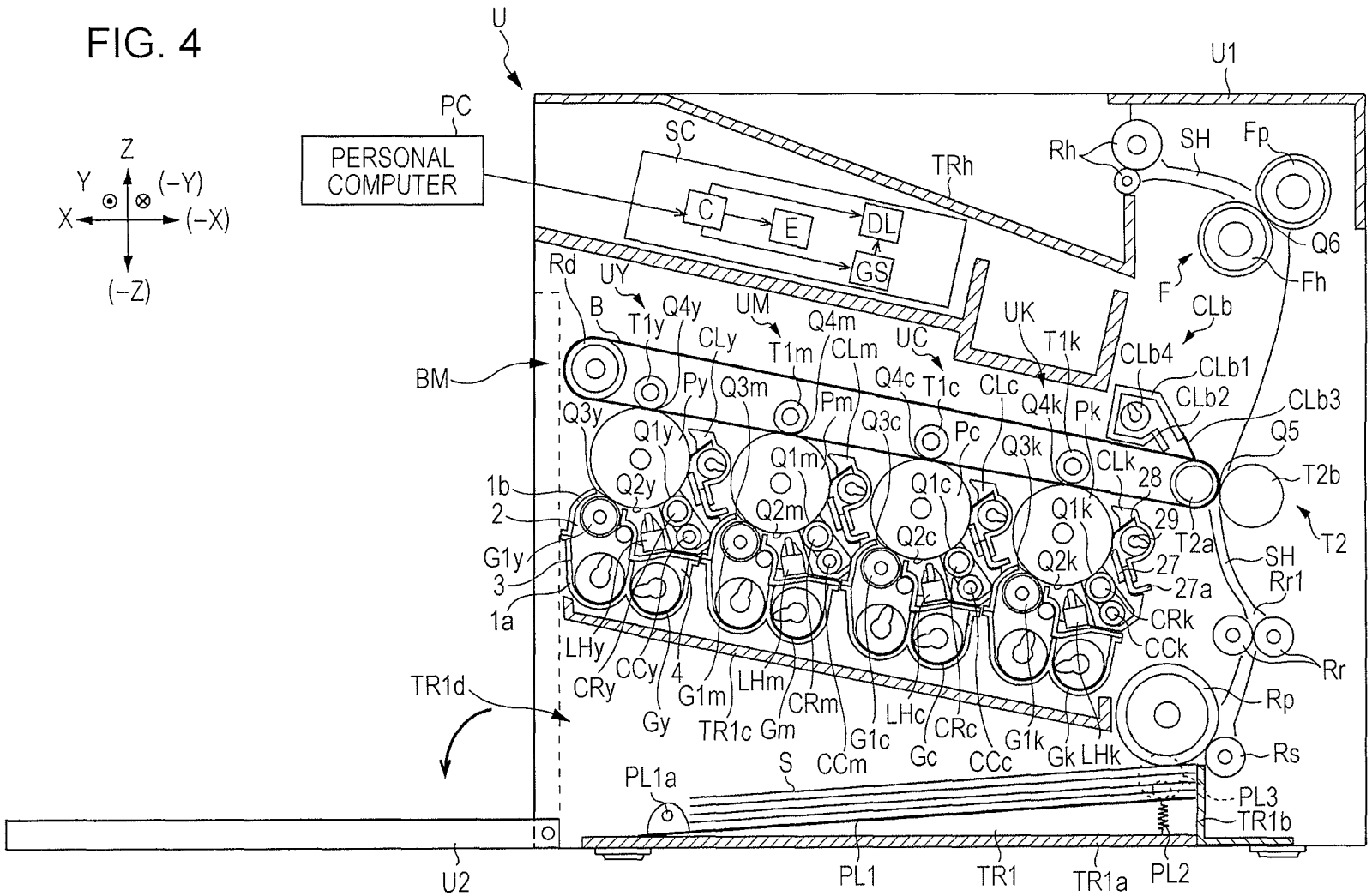
FIG. 4 illustrates the entire image forming apparatus according to the first exemplary embodiment of the present invention.

FIG. 4 illustrates the entire image forming apparatus U according to the first exemplary embodiment of the present invention.

In FIGS. 1 and 4, the front cover U2 is supported so as to be movable between an open position (indicated by a solid line in FIG. 4), where a recording sheet S (serving as an exemplary medium) is insertable, and a closed position shown in FIG. 1 and indicated by broken lines in FIG. 4.

In FIG. 4, a control substrate SC (on which, for example, various control circuits and storage media are arranged) is disposed at the upper portion of the printer U so as to be situated below the discharge tray TRh. A controller C, an image processing section GS, a driving circuit DL for forming latent images, a power supply circuit E (serving as an exemplary power supply device), etc. are provided on the control substrate SC. The controller C performs various control operations of the printer U. The image processing section GS controls an operation by the controller C. The power supply circuit E applies voltage to, for example, charging rollers CRy to CRk (serving as exemplary charging devices (described later)), developing rollers G1*y* to G1*k* (serving as exemplary developing members), and transfer rollers T1*y* to T1*k* (serving as exemplary transfer devices).

The image processing section GS converts print information into image information used for forming latent images corresponding to images of four colors (that is, the yellow (Y) image, the magenta (M) image, the cyan (C) image, and the black (K) image), and outputs the converted image information to the driving circuit DL at a preset time. The print information is input from, for example, a personal computer serving as an exemplary external image information transmitting apparatus electrically connected to the printer U.

When a document image is a single-color image, that is, a monochromatic image, only the black image information is input to the driving circuit DL.

The driving circuit DL includes driving circuits for the respective colors Y, M, C, and K (not shown). At a predetermined time, the driving circuit DL outputs a signal corresponding to the input image information to LED heads LHy, LHm, LHc, and LHk serving as exemplary latent image forming devices disposed in correspondence with the respective colors.

Visible image forming devices UY, UM, UC, and UK that form toner images are disposed at the lower center of the printer body U1. The toner images are exemplary visible images for the respective colors, yellow, magenta, cyan, and black. In FIG. 4, the visible image forming device UK for black, that is, K includes a photoconductor member Pk serving as an exemplary image bearing member that rotates. The charging roller CRk (serving as an exemplary device that charges the surface of the photoconductor member Pk), the LED head LHk (serving as an exemplary latent image forming device that forms an electrostatic latent image on the surface of the photoconductor member), a developing device Gk that develops the electrostatic latent image on the surface of the photoconductor member into a visible image, and a photoconductor-member cleaner CLk (serving as an exemplary cleaning device used for the image bearing member for removing any developer remaining on the surface of the photoconductor member Pk), etc. are disposed around the photoconductor member Pk.

The visible image forming devices UY, UM, and UC for the other colors have structures that are similar to that of the black visible image forming device UK.

After the surfaces of photoconductor members Py to Pk are uniformly charged at respective charging areas Q1*y*, Q1*m*, Q1*c*, and Q1K (opposing the charging rollers CRy to CRk) by the charging rollers CRy to CRk, the LED heads LHy to LHk form latent images on latent image formation areas Q2*y*, Q2*m*, Q2*c*, and Q2*k*. The formed electrostatic latent images are developed into toner images at developing areas Q3*y*, Q3*m*, Q3*c*, and Q3*k* opposing developing devices Gy to Gc and the developing device Gk. The developed toner images are transported to first transfer areas Q4*y*, Q4*m*, Q4*c*, and Q4*k* that contact an intermediate transfer belt B serving as an exemplary intermediate transfer body. A first transfer voltage having a polarity that is opposite to a charging polarity of the toner is applied to the first transfer rollers T1*y*, T1*m*, T1*c*, and T1*k* at a time that is previously set from the power supply circuit E controlled by the controller C. The first transfer rollers T1*y*, T1*m*, T1*c*, and T1*k* are exemplary first transfer units disposed at a back-surface side of the intermediate transfer belt B in the first transfer areas Q4*y*, Q4*m*, Q4*c*, and Q4*k*.

The first transfer rollers T1*y*, T1*m*, T1*c*, and T1*k* transfer the toner images on the respective photoconductor members Py to Pk to the intermediate transfer belt B by first transfer operations.

Any extraneous matter and residual matter such as discharge products and residual toner remaining on the surfaces of the photoconductor members Py, Pm, Pc, and Pk after the first transfer are cleaned off by photoconductor-member cleaners CLy, CLm, and CLk, and the photoconductor-member cleaner CLk, respectively. The surfaces of the photoconductor members Py, Pm, Pc, and Pk that are cleaned are re-charged by the charging rollers CRy, CRm, CRc, and CRk. For example, any residual matter adhered to the charging rollers Cry to CRk that is not completely removed by the photoconductor-member cleaners CLy to CLk is cleaned off by charging-device cleaners CCy, CCm, CCc, and CCk serving as exemplary cleaning members for the charging devices disposed in contact with the charging rollers Cry to CRk.

In FIGS. 2 and 4, a belt module BM serving as an exemplary intermediate transfer unit is disposed above the photoconductor members Py to Pk. The belt module BM includes the intermediate transfer belt B serving as an exemplary intermediate transfer body which is a member to which a transfer operation is performed. The intermediate transfer belt B is rotatably supported by an intermediate transfer supporting system including a belt driving roller Rd (serving as an exemplary driving member), a backup roller T2*a* (serving as an exemplary driven member and a second-transfer opposing member), and the first transfer rollers T1*y*, T1*m*, T1*c*, and T1*k* disposed so as to oppose the respective photoconductor members Py to Pk. The intermediate transfer body is not limited to a belt, so that, for example, drums and other types of related intermediate transfer bodies that are publicly known may also be used.

A belt cleaner CLb serving as an exemplary cleaning device for the intermediate transfer body is disposed at the upper back side of the intermediate transfer belt B. The belt cleaner CLb includes a cleaning container CLb1, a belt cleaning blade CLb2, a film CLb3, and a residual matter transporting member CLb4. The cleaning blade CLb2 is an exemplary cleaning member that is supported by the cleaning container CLb1 and that contacts the intermediate transfer belt B to remove and clean off any residual matter remaining on the surface of the intermediate transfer belt B. The film CLb3 is an exemplary leakage preventing member for preventing flying and leakage of the residual matter removed by the belt cleaning blade CLb2. The residual matter transporting member CLb4 is disposed in the cleaning container CLb1, and transports and discharges the removed residual matter. The cleaning container CLb1 in the first exemplary embodiment is disposed above the black photoconductor-member cleaner CLk.

A second transfer roller T2*b* serving as an exemplary second transfer member is disposed so as to oppose the surface of the intermediate transfer belt B that contacts the backup roller T2*a*. The backup roller T2*a* and the second transfer roller T2*b* constitute a second transfer device T2 in the first exemplary embodiment. An area where the second transfer roller T2*b* and the intermediate transfer belt B oppose each other constitutes a second transfer area Q5.

Single color or multicolor toner images successively superimposed upon and transferred to the intermediate transfer belt B by the first transfer rollers T1*y*, T1*m*, T1*c*, and T1*k* at the first transfer areas Q4*y*, Q4*m*, Q4*c*, and A4*k* are transported to the second transfer area Q5.

The first transfer rollers T1*y* to T1*k*, the intermediate transfer belt B, the second transfer device T2, etc. constitute the transfer devices T1*y* to T1*k*, T2, and B.

As shown in FIG. 4, the intermediate transfer belt B in the first exemplary embodiment is disposed so that the first transfer areas Q1*y* to Q1*k* are inclined downward towards the rear with respect to a horizontal plane. Accordingly, the visible image forming devices Uy to UK are positioned so that one is displaced downward from another in a direction of gravitational force towards a downstream side in a direction of rotation of the belt.

A feeding tray TR serving as an exemplary medium holding section is provided below the visible image forming devices UY to UK. The feeding tray TR1 has a bottom wall TR1*a*, a back end wall TR1*b*, and an upper wall TR1*c*. The bottom wall TR1*a* serves as an exemplary lower wall. The back end wall TR1*b* extends upward from the back end of the bottom wall TR1*a*. The upper wall TR1*c* is disposed above the bottom wall TR1*a* so as to oppose the bottom wall TR1*a*. A replenishing opening TR1*d* for replenishing the feeding tray TR1 with new recording sheets S is formed in the front end of the feeding tray TR1. The front end of the upper wall TR1*c* is formed so as to be inclined upward in a direction of the outer side of the replenishing opening TR1*d*, that is, towards the front. Therefore, the replenishing opening TR1*d* is formed so that the distance between the upper wall TR1*c* and the bottom wall TR1*a* increases towards the front, and so that the replenishing opening TR1*d* widens towards the front.

A rising-lowering plate PL1 serving as a medium loading section is disposed at the bottom wall TR1*a*. The rising-lowering plate PL1 is supported so as to be rotatable around a rotational center PL1*a*, has recording sheets S (serving as exemplary media) loaded thereupon, and raises and lowers the recording sheets S. A rising-lowering spring PL2 serving as an exemplary biasing member that biases the back end of the rising-lowering plate PL1 upward is disposed at the back end of the rising-lowering plate PL1. When image formation is not performed, the rising-lowering plate PL1 is moved to a lowering position by push-down members PL3 that are eccentric cams. The push-down members PL3 are disposed at the left and right ends of the rising-lowering plate PL1. The lowering position is where the rising-lowering plate PL1 is held parallel to the bottom wall TR1*a*. While image formation is being performed, the rising-lowering plate PL1 is supported so as to be movable between the lower position and a rising position shown in FIG. 4 where the rising-lowering plate PL1 is raised by the rising-lowering spring PL2 when the push-down members PL3 rotate.

When the front cover U2 is opened, the replenishing opening TR1*d* is open to the outside. When the replenishing opening TR1*d* is open, it is possible to insert a bundle of new recording sheets S until they strike the back end wall TR1*b*, and load the bundle of recording sheets S on the rising-lowering plate PL1 at the lowering position.

A feeding roller Rp serving as an exemplary sending-out member is disposed behind the upper wall TR1*c*. With the rising-lowering plate PL1 being moved to the rising position, the feeding roller Rp is disposed where the topmost recording sheet S of the loaded bundle of recording sheets S is pressed against the feeding roller Rp by a spring force of the rising-lowering spring PL2. A retard roller Rs serving as an exemplary member is disposed above the back end wall TR1*b*.

The recording sheets S loaded on the feeding tray TR1 are sent out by the feeding roller Rp, are separated one sheet at a time at a contact area between the retard roller Rs and the feeding roller Rp, and are transported to a medium transport path SH. The recording sheet S in the medium transport path SH is transported to registration rollers Rr serving as adjusting members during sheet-feeding. The recording sheet S transported to the registration rollers Rr is sent out to the second transfer area Q5 in accordance with when the toner images on the intermediate transfer belt B reach the second transfer area Q5.

The intermediate transfer belt B after the transfer of the toner images to the second transfer area Q5 is cleaned by removing residual matter, such as discharge products and residual transfer toner remaining on the surface of the intermediate transfer belt B, by the belt cleaner CLb.

The recording sheet S having the toner images transferred thereto is transported to a fixing area Q6 of a fixing device F. The fixing device F includes a heating roller Fh (serving as an exemplary heating fixing member) and a pressure roller Fp (serving as an exemplary pressing fixing member). An area where the heating roller Fh and the pressure roller Fp contact each other by a predetermined pressure constitute the fixing area Q5. The toner images that are unfixed to the surface of the recording sheet S are fixed by heat and pressure when they pass the fixing area Q6.

The recording medium S having the images fixed thereto is transported in the medium transport path SH, and is discharged to the discharge tray TRh from discharge rollers Rh serving as exemplary medium discharge members.

Description of Visible Image Forming Devices

Figure 5A:
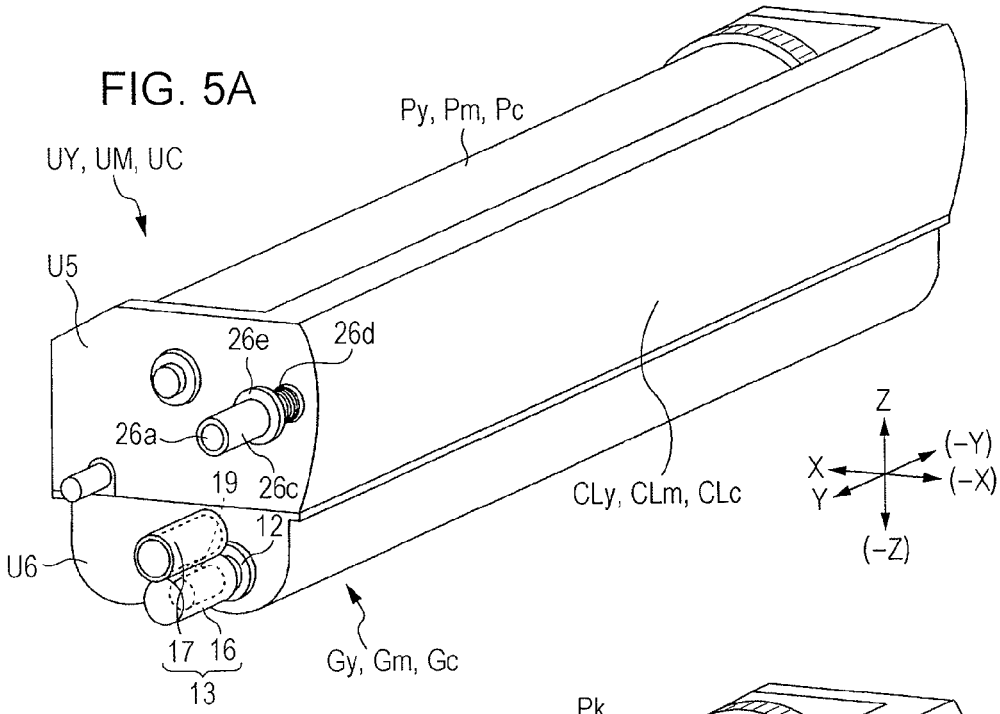
FIG. 5 illustrates principal portions of visible image forming devices according to the first exemplary embodiment, with FIG. 5A being a perspective view of the visible image forming device (representing Y, M, and C visible image forming devices), FIG. 5B being a perspective view of the K visible image forming device, and FIG. 5C being an exploded view illustrating a shutter for a waste outlet.
Figure 5B:
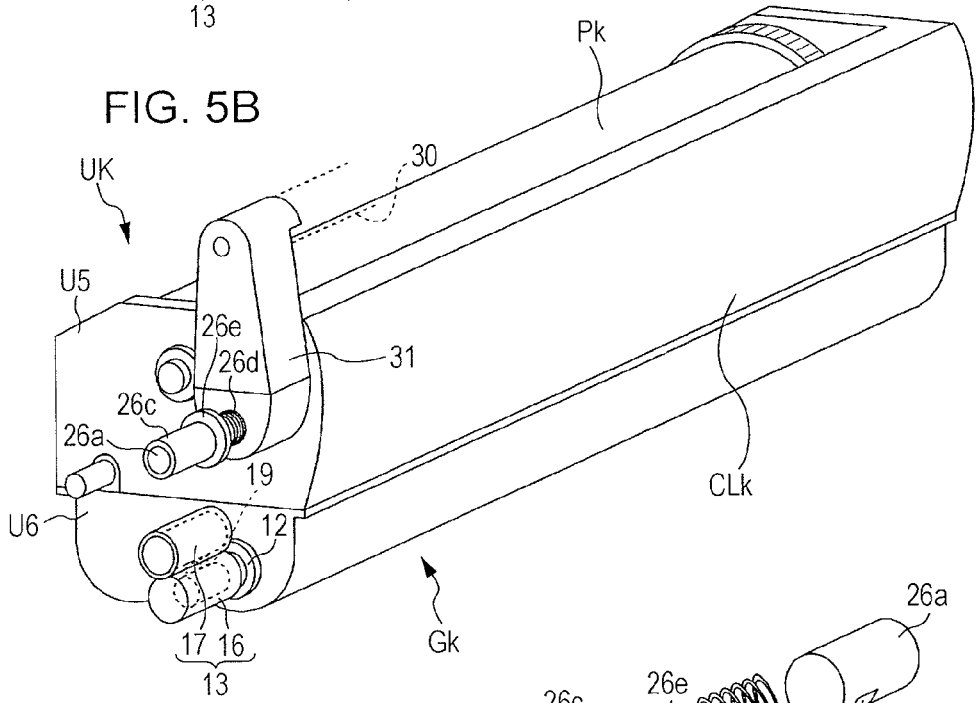
Figure 5C:
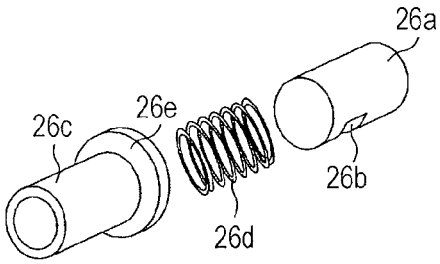

FIG. 5 illustrates principle portions of the visible image forming devices according to the first exemplary embodiment, with FIG. 5A being a perspective view of the visible image forming device (representing Y, M, and C visible image forming devices), FIG. 5B being a perspective view of the K visible image forming device, and FIG. 5C being an exploded view illustrating a waste-outlet shutter.

Figure 6:
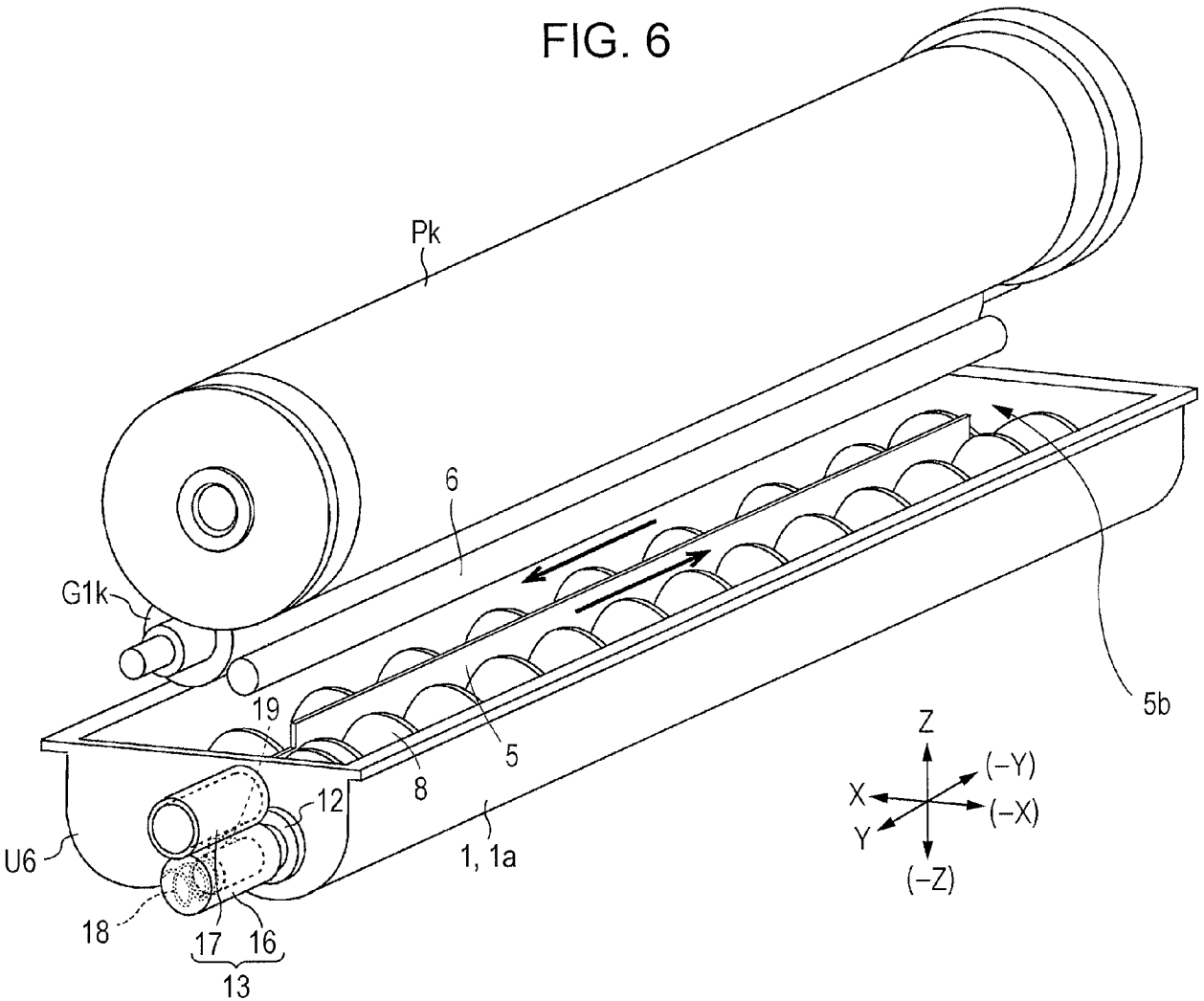
FIG. 6 illustrates a principal portion of a developing container according to the first exemplary embodiment.

FIG. 6 illustrates a principle portion of a developing container according to the first exemplary embodiment.

Figure 7:
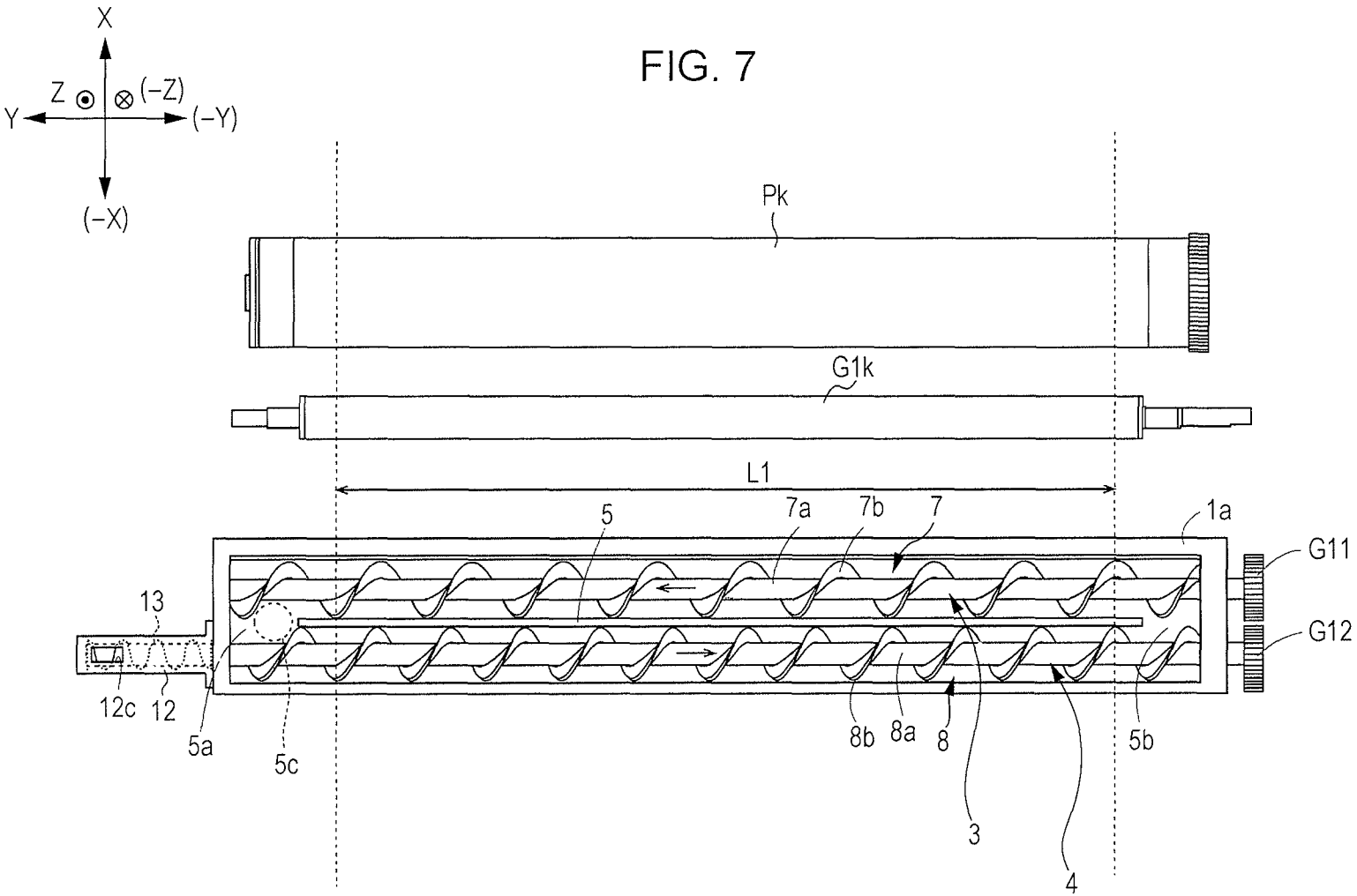
FIG. 7 is a plan view of the developing container according to the first exemplary embodiment.

FIG. 7 is a plan view of the developing container according to the first exemplary embodiment.

The visible image forming devices UY to UK will hereunder be described in detail. However, since the visible image forming devices UY to UC for the respective colors Y, M, and C have similar structures, the yellow visible image forming device UY will only be described. Therefore, the other visible image forming devices UM and UC will not be described.

In FIGS. 4 and 5A to 5C, the visible image forming devices UY to UK in the first exemplary embodiment each include a photoconductor-member unit U5 at the upper side and a developing unit U6 at the lower side. The photoconductor-member units U5 support the respective photoconductor members Py to Pk, the respective charging rollers CRy to CRk, and the respective LED heads LHy to LHk, and include the respective photoconductor-member cleaners CLy, CLm, and CLk therein. The developing units U6 include the respective developing devices Gy to Gk. Since the developing devices Gy to Gk have similar structures for the respective colors, Y, M, C, and K, only the black developing device Gk will hereunder be described. The developing devices Gy, Gm, and Gc for the other colors will not be described in detail below.

Description of Developing Devices

In FIGS. 5A to 7, in the black visible image forming device UK in the first exemplary embodiment, the developing device Gk is disposed below the photoconductor member Pk. The developing device Gk in the first exemplary embodiment includes a developing container 1 containing a developer therein. In the first exemplary embodiment, a two component developer including of toner and a carrier is used. The developing container 1 includes a container body 1*a* at the lower side and a covering member 1*b* (shown in FIG. 4) that covers the upper surface of the container body 1*a*.

A developing roller chamber 2 (shown in FIG. 4), a first stirring chamber 3, and a second stirring chamber 4 are provided in the developing container 1. The developing roller chamber 2 accommodates the developing roller G1*k*. The first stifling chamber 3 is disposed adjacent to, below, and continuously with the developing roller chamber 2. The second stirring chamber 4 is formed behind and adjacent to the first stirring chamber 3.

The first stirring chamber 3 and the second stirring chamber 4 are divided by a partition wall 5 serving as an exemplary dividing member that extends in the left-right direction. Inflow portions 5*a* and 5*b* formed at the left and right ends of the partition wall 5 allow a developer in the first stirring chamber 3 to flow into the second stirring chamber 4, and a developer in the second stirring chamber 4 to flow into the first stirring chamber 3. In the first exemplary embodiment, in order to reduce the supply of a newly replenished developer in an insufficiently stirred state to the developing roller G1*k*, a new developer is replenished to a replenishing developer inflow position 5*c* that is set at the right inflow portion 5*a*. In FIG. 7, in the first exemplary embodiment, in order to reduce an adverse effect on image formation by a developer that is newly replenished or a developer that accumulates in the inflow portions 5*a* and 5*b*, the inflow portions 5*a* and 5*b* are formed in correspondence with an outer side of an image formation area L1 where the image formation is performed on the photoconductor member Pk. The image formation area L1 serves as an exemplary bearing area where the image bearing member bears an image.

In FIGS. 5A to 7, the direction of rotation of the developing roller G1*k* in the first exemplary embodiment is opposite to that of the photoconductor member Pk. That is, in FIG. 4, the developing roller G1*k* in the first exemplary embodiment rotates counterclockwise that is opposite to the direction of rotation of the photoconductor member Pk that rotates clockwise. Therefore, in the developing area Q3*k*, the surface of the photoconductor member Pk and the surface of the developing roller G1*k* rotate in the same direction.

In the developing roller chamber 2, a rod-like layer-thickness regulating member 6 that regulates the thickness of a developer layer on the surface of the developing roller G1*k* is supported upstream in the direction of rotation from the developing roller G1*k* with respect to the development area Q3*k*. The layer-thickness regulating member 6 is disposed so as to oppose the developing roller G1*k*.

A supply auger 7 serving as an exemplary transporting member and an exemplary first stirring member extending in the left-right direction is rotatably supported in the first stirring chamber 3. An admixture auger 8 serving as an exemplary transporting member and an exemplary second stirring member extending in the left-right direction next to the supply auger 7 is rotatably supported in the second stirring chamber 4. The supply auger 7 includes a rotating shaft 7*a* and a helical stirring blade 7*b* supported at the outer periphery of the rotating shaft 7*a*. The admixture auger 8 includes a rotating shaft 8*a* and a helical stirring blade 8*b* supported at the outer periphery of the rotating shaft 8*a*.

Gears G11 and G12 serving as exemplary gears that engage each other are supported at the left ends of the respective rotating shafts 7*a* and 8*a*. When a driving force is transmitted to the gears G11 and G12 from a developing driving source (not shown), the augers 7 and 8 are rotationally driven, so that, as shown by arrows in FIG. 7, the developers are transported in opposite directions. Therefore, the developers that are transported while being stirred to a downstream end of one of the stirring chambers 3 and 4 by the rotations of the augers 7 and 8 flow into and are transported to an upstream end of the other of the stirring chambers 4 and 3 through the inflow portions 5*a* and 5*b*. Therefore, the developer in the developing container 1 circulates in the stirring chambers 3 and 4, and the developer in the first stirring chamber 3 is supplied to the developing roller G1*k*, and used for developing an image.

In FIGS. 5A to 7, a replenishing cylinder 12 extending along the axial direction of the rotating shaft 8*a* of the admixture auger 8 is supported at the right end of the developing container 1. A replenishing auger 13 is continuously formed with an axial-direction outer end of the rotating shaft 8*a* of the admixture auger 8. In FIG. 7, an inlet 12*c* for a replenishing developer is formed at the upper surface of an end portion of the replenishing cylinder 12.

In FIGS. 5A to 7, an inlet shutter 13 serving as an inlet covering member is mounted to the replenishing cylinder 12. The inlet shutter 13 in the first exemplary embodiment includes a lower cylindrical portion 16 and an upper cylindrical portion 17. The lower cylindrical portion 16 is supported so as to be movable in the left-right direction while it is fitted to the replenishing cylinder 12. The upper cylindrical portion 17 is integrated to an upper portion of the lower cylindrical portion 16.

The right end (outer end) of the lower cylindrical portion 16 is covered by an end wall. A cylinder biasing spring 18 serving as an exemplary biasing member is mounted in the lower cylindrical portion 16 so as to be situated between the end wall and the replenishing cylinder 12. The lower cylindrical portion 16 and the upper cylindrical portion 17 are connected by a replenishing inflow path 19 extending in the up-down direction. Therefore, the inlet shutter 13 is supported so as to be movable between an open position and a closed position. The open position is where the replenishing inflow path 19 and the inlet 12*c* for a replenishing developer are connected to each other as a result of moving the inlet shutter 13 rightwards in the axial direction against an elastic force of the cylinder biasing spring 18. The closed position is where the replenishing inflow path 19 and the inlet 12*c* for a replenishing developer are displaced from each other as a result of the inlet shutter 13 moving leftwards in the axial direction from the open position by elastic force of the cylinder biasing spring 18.

The left end (inner end) of the upper cylindrical portion 17 is covered by an end wall. A projecting movement-in-response open portion extending rightward from the left end wall is formed in the upper cylindrical portion 17.

Description of Photoconductor-Member Cleaner

In FIGS. 4 to 7, in the visible image forming device UK in the first exemplary embodiment, the photoconductor member cleaner CLk is disposed behind the photoconductor member Pk. The photoconductor-member cleaner CLk in the first exemplary embodiment includes a cleaner container 26 (shown in FIG. 19), a cleaning blade 27, and a leakage preventing film 28. The cleaner container 26 is an exemplary cleaning container body. The cleaning blade 27 is an exemplary cleaning member whose base end is supported by the cleaner container 26 through a blade supporting member 27*a*, and whose front end contacts the photoconductor member Pk. The leakage preventing film 28 is an exemplary leakage preventing member that is supported by the cleaner container 26 and that prevents leakage of a developer by contacting the photoconductor member Pk at a side that is upstream from the cleaning blade 27 in the direction of rotation of the photoconductor member Pk.

In FIG. 5C, a residual developer transport path 26*a* extending towards the cartridge mounting/removing section U4 (at the outer side) from the photoconductor-member cleaner CLk (at the inner side) is connected to the cleaner container 26. A residual developer outlet 26*b* where the residual developer that is transported through the residual developer transport path 26*a* flows out is formed at the right end (downstream end) of the residual developer transport path 26*a*. The residual developer transport path 26*a* is disposed obliquely above the replenishing cylinder 12 so as to be situated adjacent to and beside the replenishing cylinder 12.

In FIGS. 5A and 5C, in each of the Y, M, and C visible image forming devices UY to UC, the rightwardly extending residual developer transport path 26*a* and the residual developer outlet 26*b* are provided at the right end of the photoconductor unit U5. A cylindrical waste outlet shutter 26*c* serving as an exemplary outlet covering member is supported by the right end of the residual developer transport path 26*a* so as to be movable in the left-right direction. The waste outlet shutter 26*c* has a flange 26*e*. By a spring 26*d* serving as an exemplary biasing member disposed between the flange 26*e* and the right end of the photoconductor unit U5, the waste outlet shutter 26*c* is biased so as to move to and so as to be held at an outlet covered position.

Figure 19:
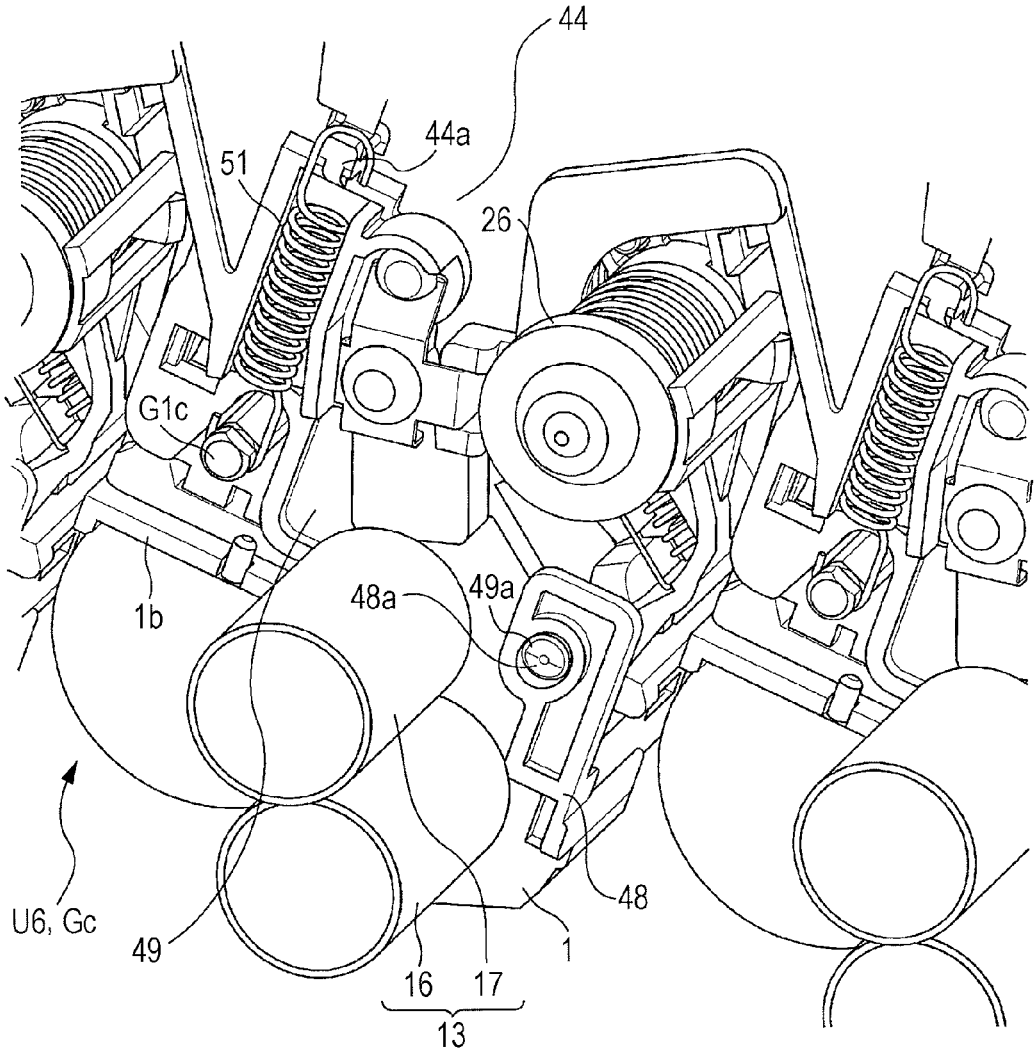
FIG. 19 illustrates a principal portion of the right end of the body of the recording unit.

In FIGS. 5A to 6, a waste auger 29 is rotatably supported in the residual developer transport path 26*a* and the cleaner container 26 (shown in FIG. 19). The waste auger 29 (shown in FIG. 4) is an exemplary developer waste member that transports any developer collected by the cleaning blade 27 (shown in FIG. 4) towards the residual developer outlet 26*b*. Like the augers 7 and 8, the waste auger 29 includes a rotating shaft a helical stifling blade supported at the outer periphery of the rotating shaft.

In FIG. 5B, in the K visible image forming device UK, a merging path 31 extending in the up-down direction is connected to the K residual developer transport path 26*a*. The merging path 31 connects the residual developer transport path 30, extending from the belt cleaner CLb disposed thereabove, to the residual developer transport path 26*a*. Therefore, any developer collected by the belt cleaner CLb is transported to the residual developer transport path 30 by the residual matter transporting member CLb 4, flows into the black residual developer transport path 26*a*, and is transported downstream by the black waste auger 29.

Figure 8:
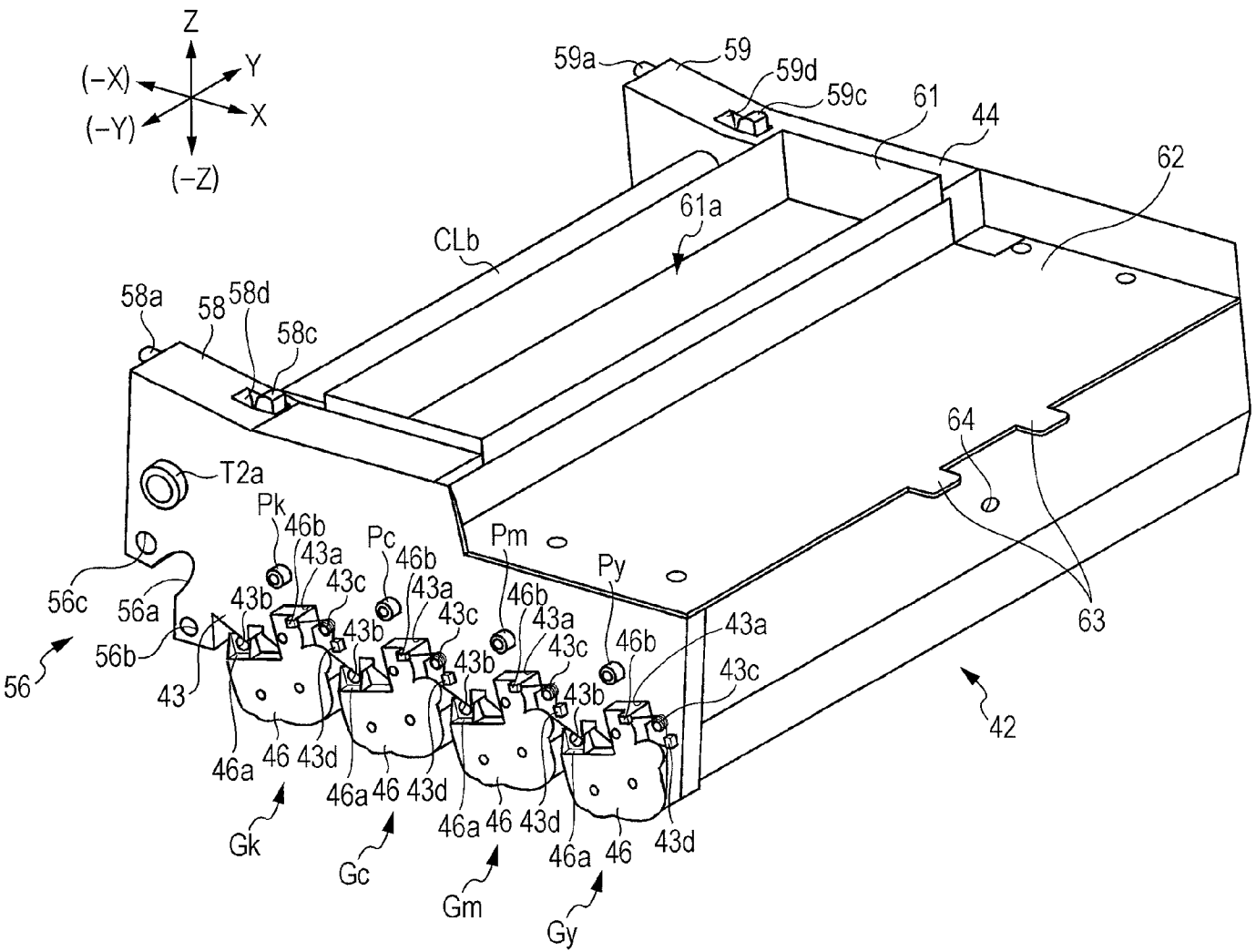
FIG. 8 illustrates a principal portion of a body of an image recording unit according to the first exemplary embodiment.

FIG. 8 illustrates a principal portion of a body of an image recording unit according to the first exemplary embodiment.

Figure 9:
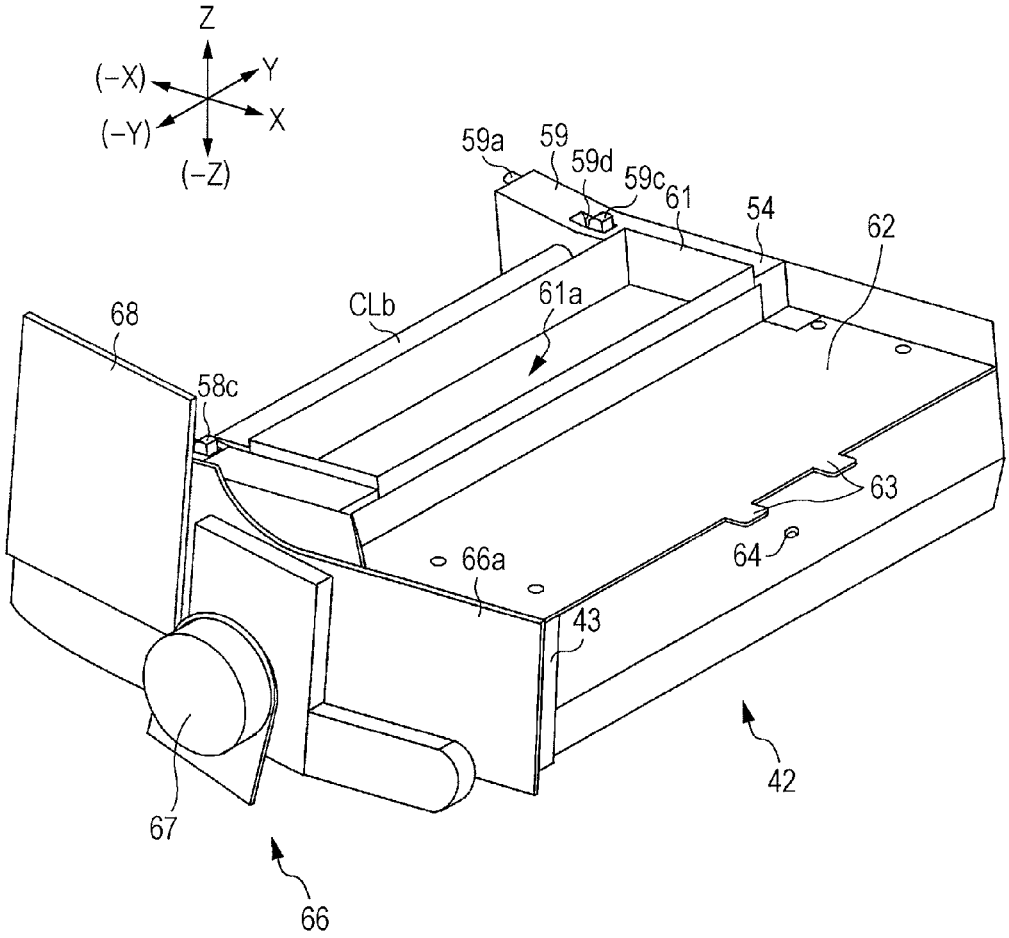
FIG. 9 illustrates a state in which a driving unit is mounted to the body of the image recording unit shown in FIG. 8.

FIG. 9 illustrates a state in which a driving unit is mounted to the body of the image recording unit shown in FIG. 8.

Figure 10:
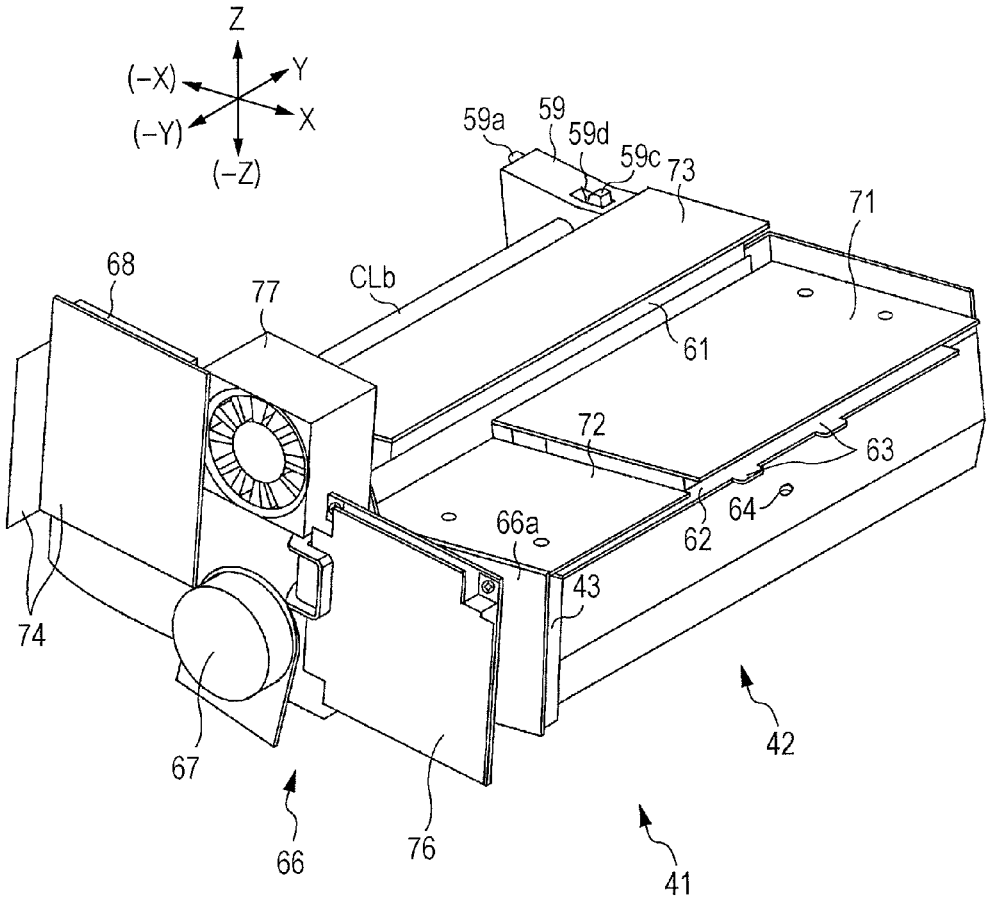
FIG. 10 illustrates a state in which, for example, a circuit board is mounted in the state shown in FIG. 9.

FIG. 10 illustrates a state in which, for example, a circuit board is mounted in the state shown in FIG. 9.

Figure 11A:
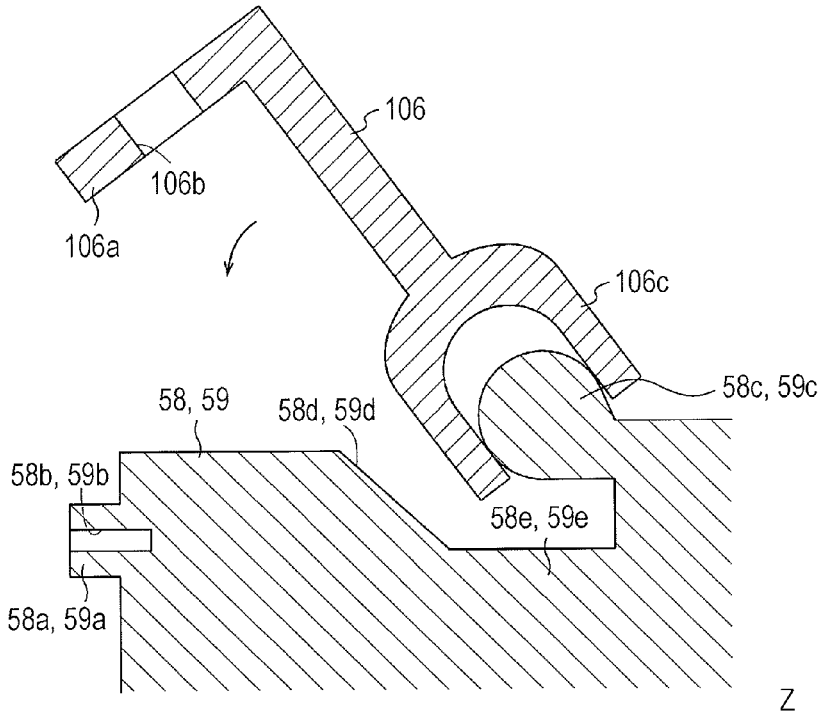
FIGS. 11A and 11B are each an enlarged view of a principal portion of a fixing unit supporting section, with FIG. 11A illustrating a state in which a support portion of a fixing unit is partially mounted to the fixing unit supporting section, and FIG. 11B illustrating a state in which the support portion of the fixing unit is completely mounted to the fixing unit supporting section.
Figure 11B:
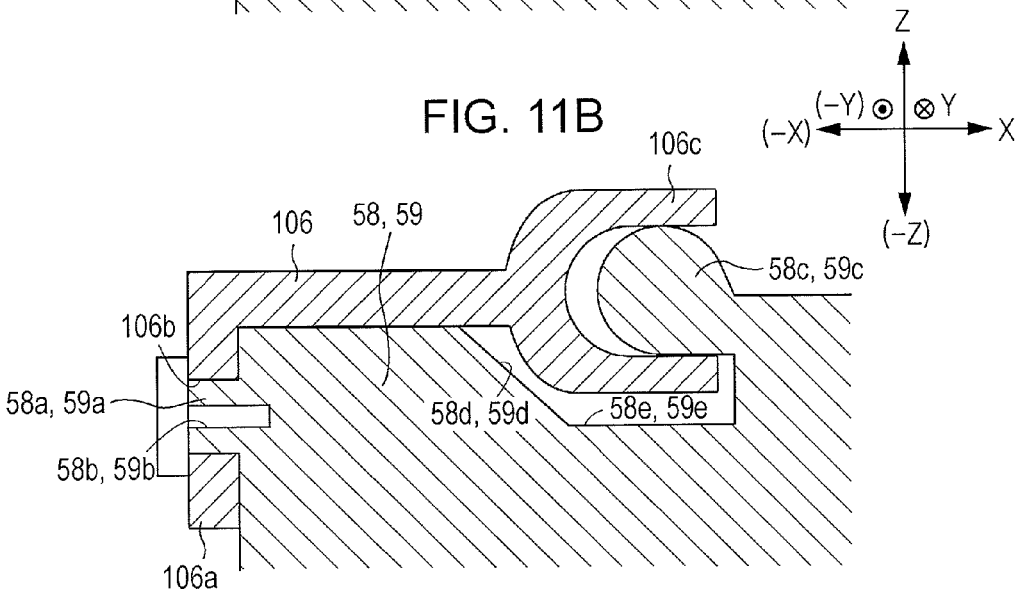

FIGS. 11A and 11B are each an enlarged view of a principal portion of a fixing unit supporting section, with FIG. 11A illustrating a state in which a support portion of a fixing unit is partially mounted to the fixing unit supporting section, and FIG. 11B illustrating a state in which the support portion of the fixing unit is completely mounted to the fixing unit supporting section.

Figure 12:
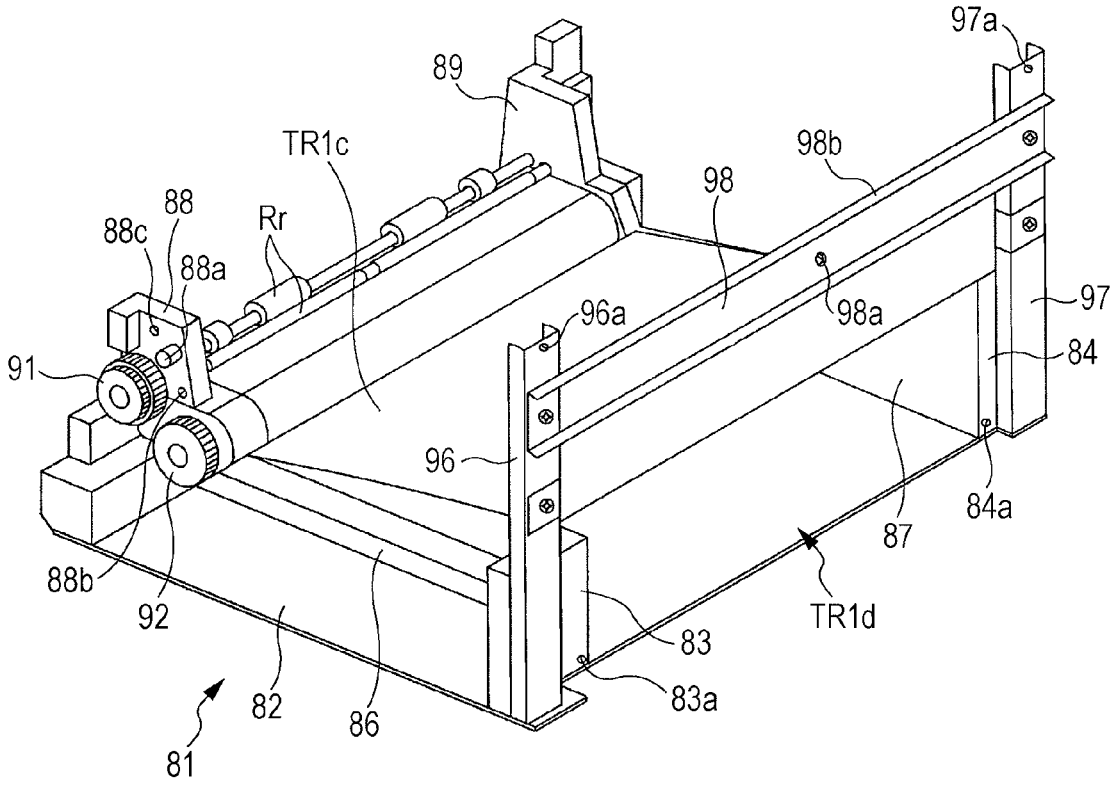
FIG. 12 is a perspective view illustrating a principal portion of a medium transporting unit serving as an exemplary second unit according to the first exemplary embodiment.

FIG. 12 is a perspective view illustrating a principal portion of a medium transporting unit serving as an exemplary second unit according to the first exemplary embodiment.

Figure 13:
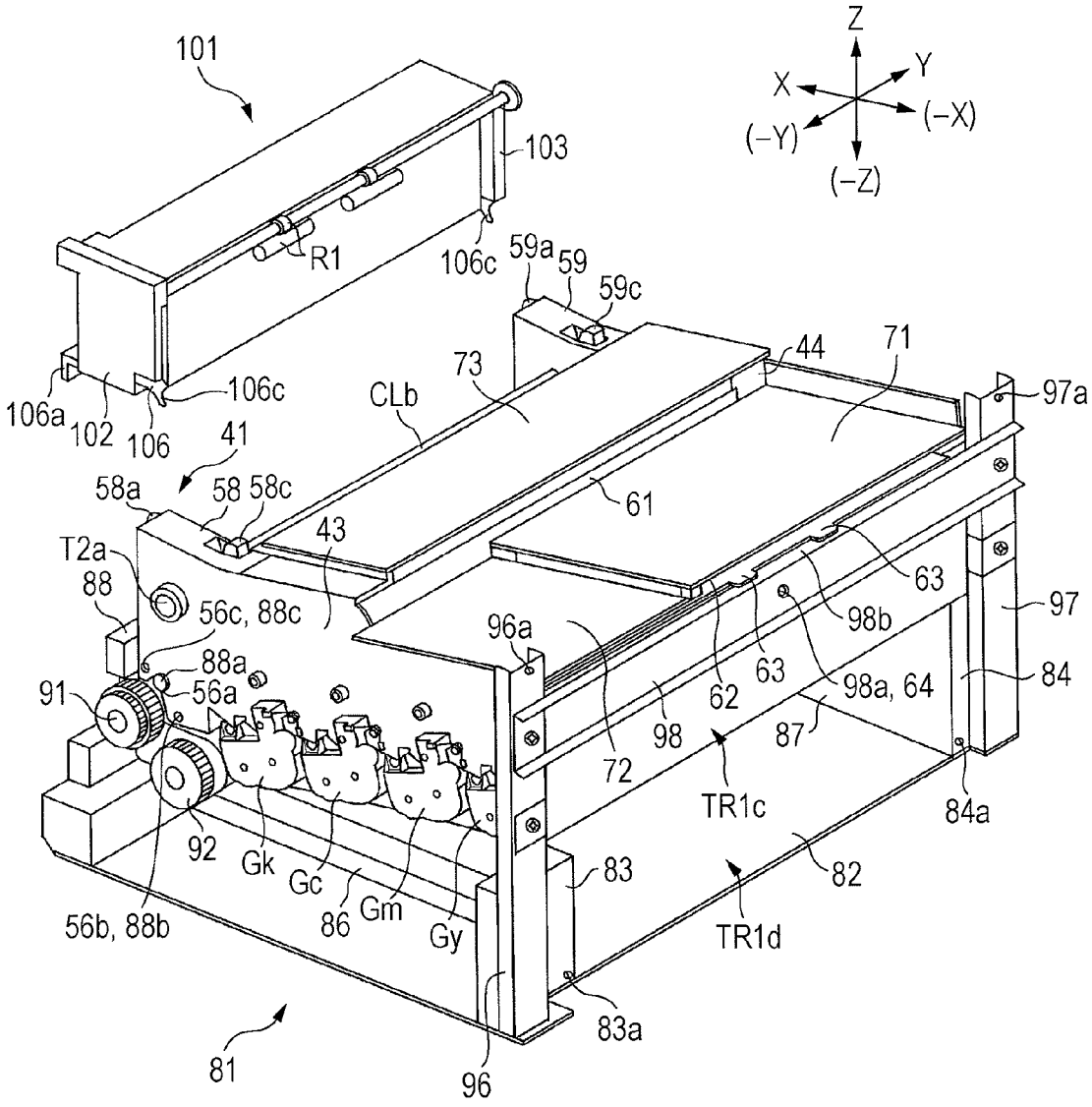
FIG. 13 illustrates a state in which the medium transporting unit and the image recording unit are connected to each other.

FIG. 13 illustrates a state in which the medium transporting unit and the image recording unit are connected to each other.

Figure 14:
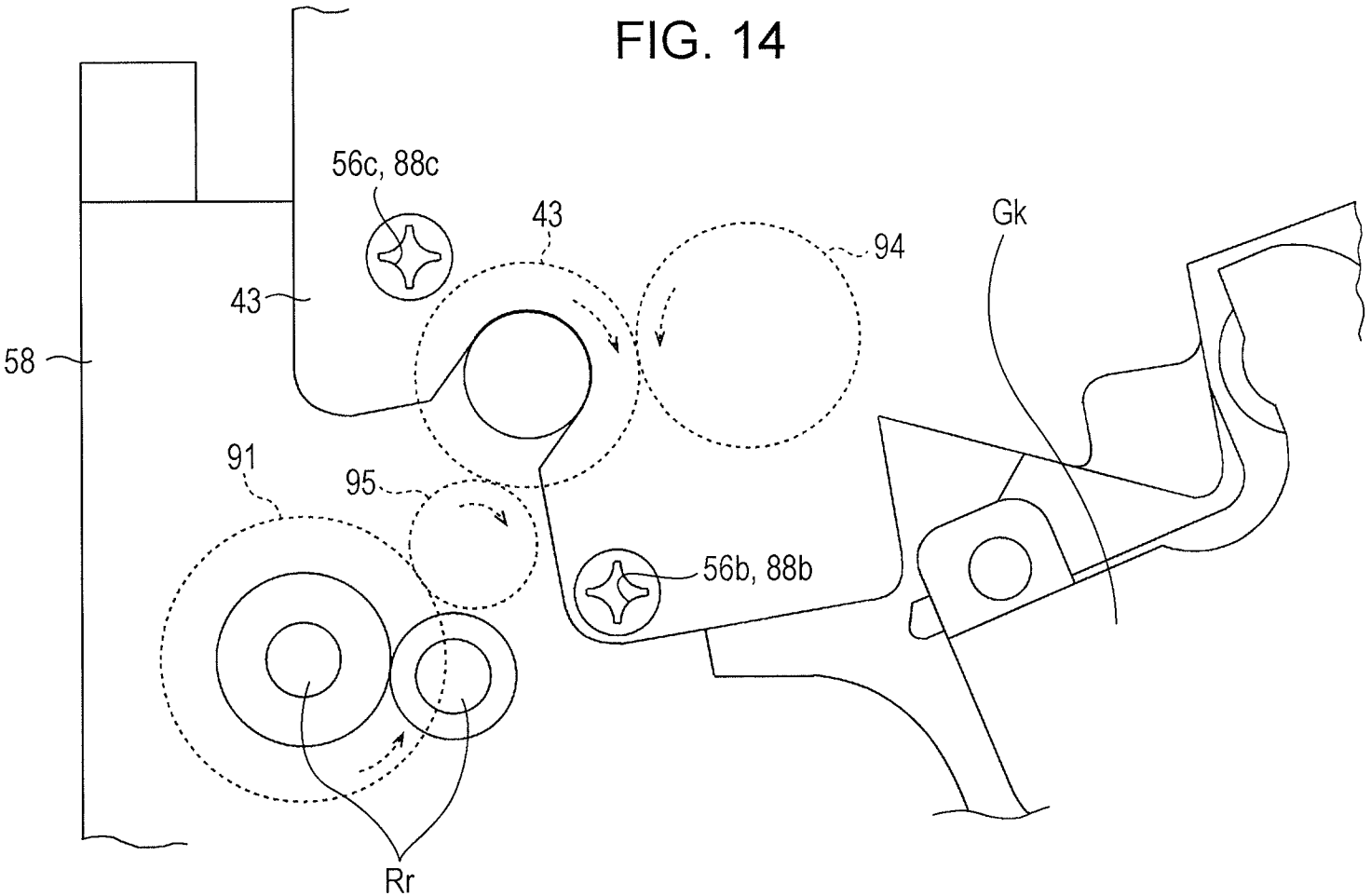
FIG. 14 illustrates a principal portion of a first securing section.

FIG. 14 illustrates a principal portion of a first securing section.

Figure 15:
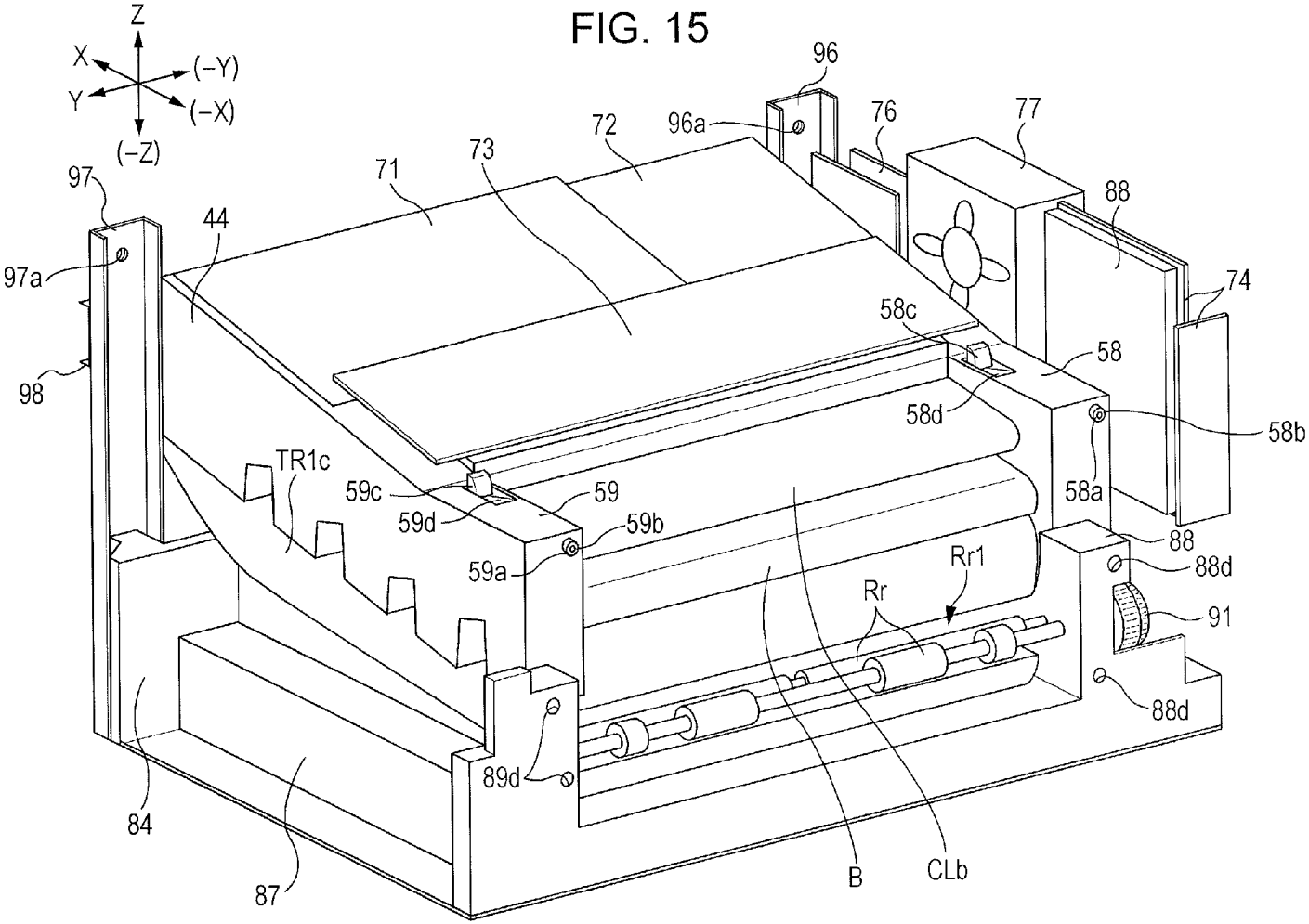
FIG. 15 is a rear perspective view showing a state in which the medium transporting unit and the image recording unit are connected to each other as seen obliquely from the right.

FIG. 15 is a rear perspective view showing a state in which the medium transporting unit and the image recording unit are connected to each other as seen obliquely from the right.

Figure 16:
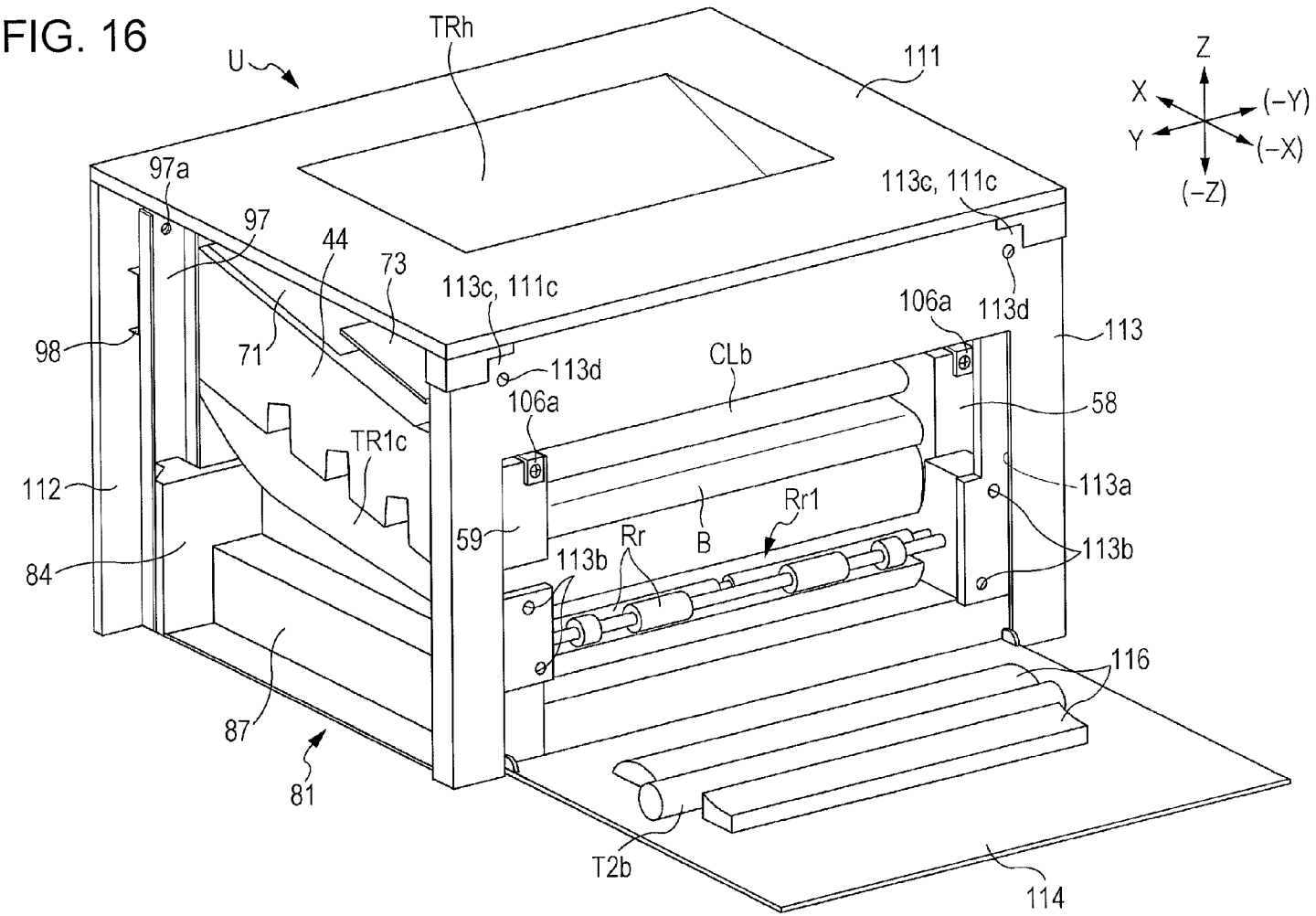
FIG. 16 is a rear perspective view illustrating a state in which exterior members are mounted, as seen obliquely from the right.
Figure 17:
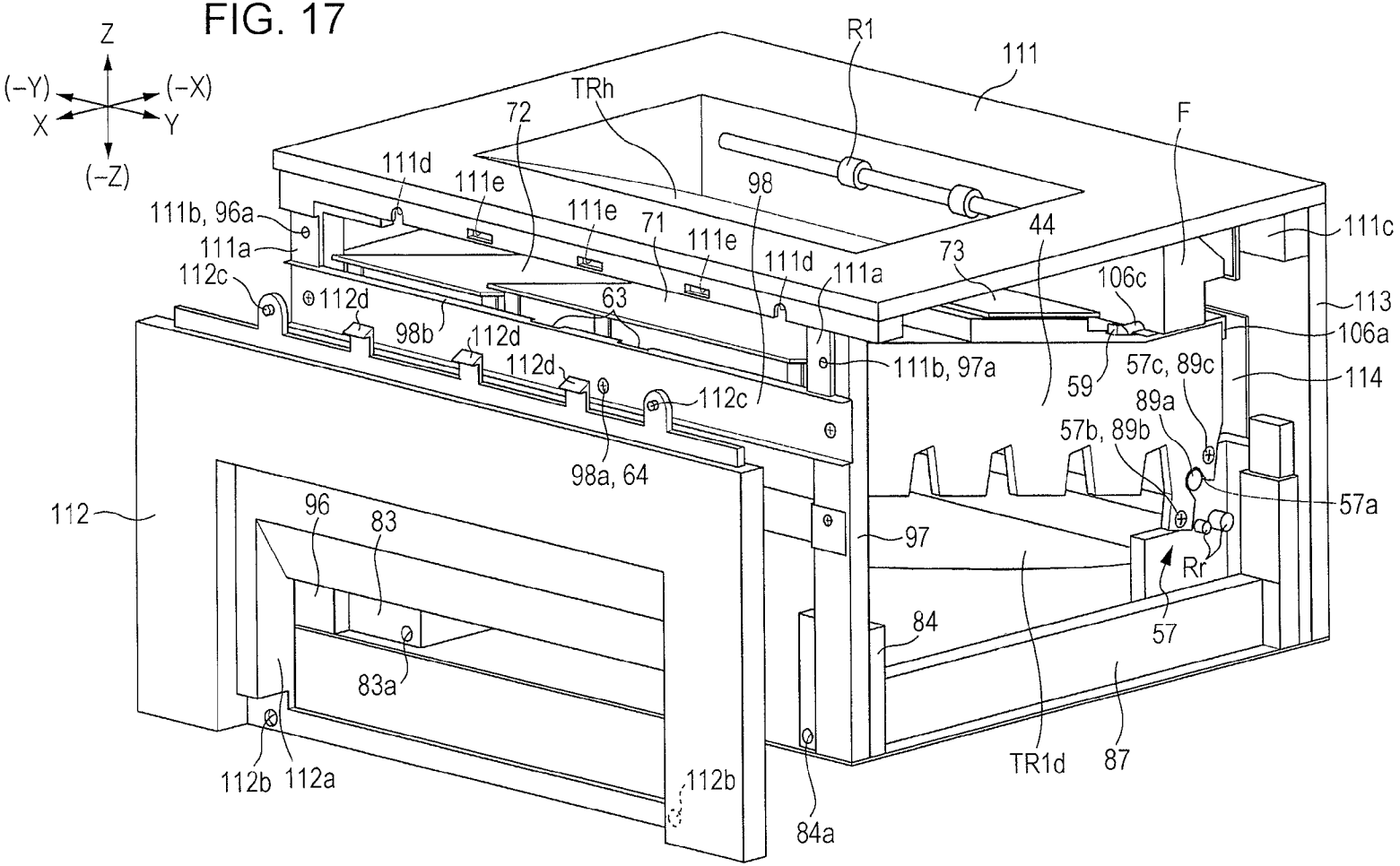
FIG. 17 is a front perspective view illustrating a state in which the exterior members are mounted as seen obliquely from the right.

FIG. 16 is a rear perspective view illustrating a state in which exterior members are mounted, as seen obliquely from the right;

FIG. 17 is a front perspective view illustrating a state in which the exterior members are mounted, as seen obliquely from the right.

In each of the figures, for the sake of facilitating understanding and description, components other than those required for the description will be omitted if necessary. For example, in FIG. 12, the driving unit is not shown, and, in FIGS. 13 to 15, the developing device, etc. are not shown.

Description of Image Recording Unit

In FIGS. 5A and 5B and FIGS. 8 to 10, an image recording unit 41 serving as an exemplary first unit in the first exemplary embodiment includes a recording unit body 42. In FIG. 8, the recording unit body 42 includes a plate-like left end wall 43 and a plate-like right end wall 44 serving as exemplary side walls. The belt module is supported between the left end wall 43 and the right end wall 44. The belt module includes the intermediate transfer belt B, the intermediate transfer supporting system, such as the backup roller T2*a*, and the belt cleaner CLb, which are unitized. The photoconductor member units U5 including the photoconductor members Py to Pk, the charging rollers CRy to CRk, the charging-device cleaners CCy to CCk, the photoconductor-member cleaners CLy to CLk, and the LED heads LHy to LHk are supported between the left end wall 43 and the right end wall. The aforementioned components of the photoconductor member units U5 are unitized. Further, the developing devices Gy, Gm, Gc, and Gk for the respective colors, that is, the developing units are supported below the recording unit body 42.

Figure 18:
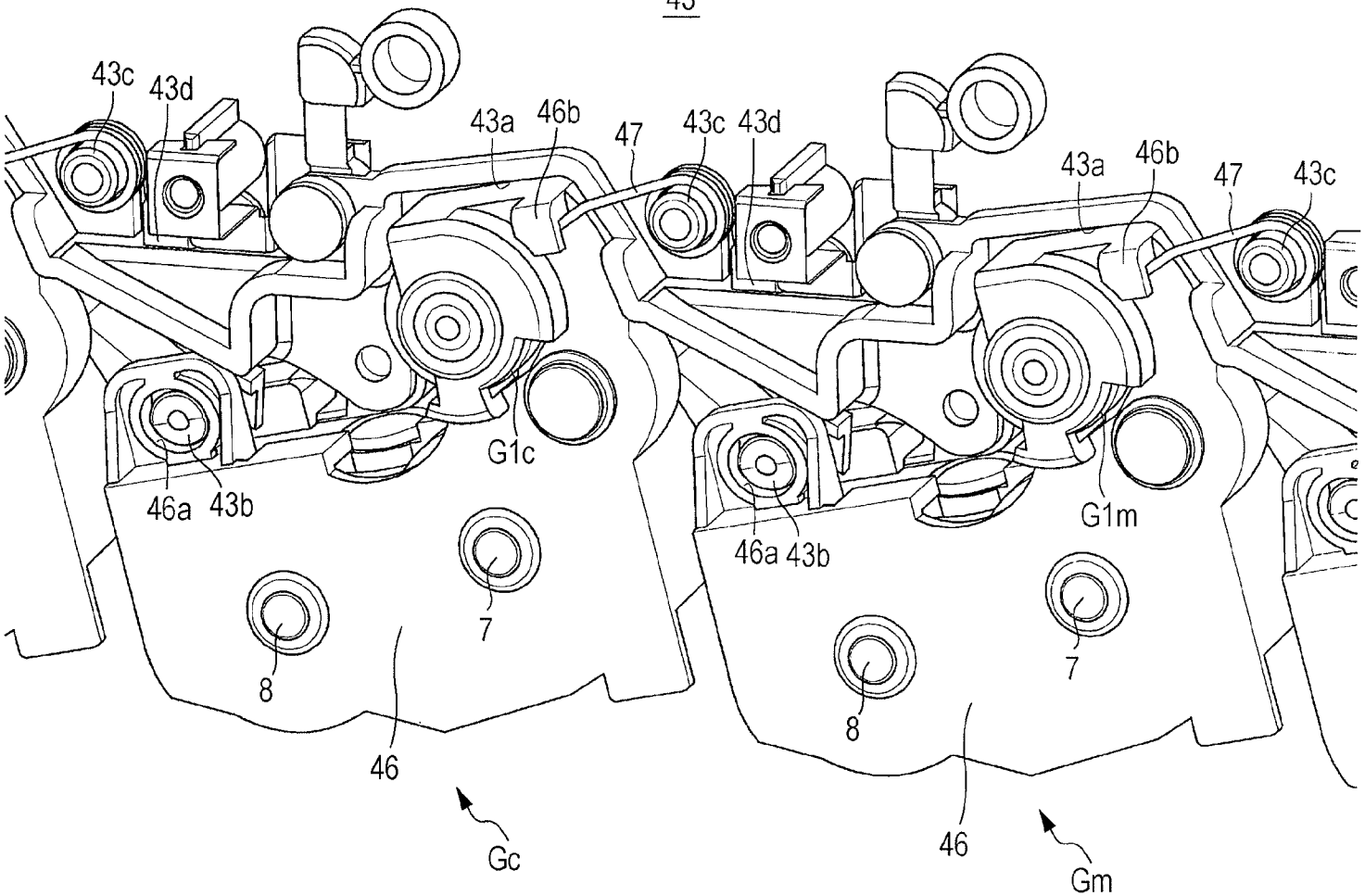
FIG. 18 illustrates a principal portion of the left end of the body of the recording unit.

FIG. 18 illustrates a principal portion of the left end of the body of the recording unit.

In FIG. 18, the left end wall 43 in the first exemplary embodiment has four recesses 43*a* that accommodate the developing rollers G1*y* to G1*k* of the respective developing devices Gy to Gk. Columnar supporting projections 43*b* serving as exemplary rotational centers and protruding leftwards are formed behind and below the respective recesses 43*a*. Each columnar supporting projection 43*b* is an exemplary supporting portion of the developing device. Columnar spring supporting projections 43*c* serving as exemplary biasing supporting portions and projecting leftwards are formed at the front sides of the respective recesses 43*a*. Spring end supporting portions 43*d* each serving as an exemplary one-end supporting portion of the corresponding biasing member and projecting leftwards are formed below and on the right of the spring supporting projections 43*c*.

In FIG. 18, protective covers 46 are supported at the left ends of the respective developing containers 1. Each protective cover 46 serves as an exemplary protective member, and protects the left end of the corresponding developing container 1 and the gears G11 and G12. Support holes 46*a* rotatably supported by the respective supporting projections 43*b* and serving as exemplary support portions for the respective developing devices are formed at the upper portions of the back ends of the respective protective covers 46. Spring end supporting portions 46*b* are formed at the respective protective covers 46 so as to be situated forwardly of and above the respective developing rollers G1*y* to G1*k*. The spring end supporting portions 46*b* are exemplary other end supporting portions of the biasing members and have the form of hook-like pawls.

Torsion springs 47 serving as exemplary biasing members are mounted to the spring supporting projections 43*c*. One end of each torsion spring 47 is supported by its corresponding spring end supporting portion 43*d*, and the other end of each torsion spring 47 is supported by its corresponding spring end supporting portion 46*b* of the protective cover 46.

Therefore, the left end of each developing container 1 in the first exemplary embodiment is supported by the unit body 42 so as to be rotatable around the corresponding supporting projection 43*b* and so that the developing rollers G1*y* to G1*k* are movable in directions in which they move towards and away from the photoconductor members Py to Pk. In addition, the left ends of the developing containers 1 are biased so that the developing rollers G1*y* to G1*k* approach the respective photoconductor members Py to Pk by elastic forces of the respective torsion springs 47.

FIG. 19 illustrates a principal portion of the right end of the body of the recording unit.

In FIG. 19, in the developing devices Gy to Gk in the first exemplary embodiment, upwardly extending linking plates 48 serving as exemplary support portions for the developing devices are supported at the right ends of the developing containers 1 so as to be situated at the upper back portions of the right ends of the respective developing containers 1. The linking plates 48 have respective support holes 48*a*, each forming a pair with the corresponding support hole 46*a*. Rightwardly extending columnar supporting projections 49*a* are formed at respective right walls 49 of the photoconductor member units U5 disposed above the respective developing devices Gy to Gk. The columnar supporting projections 49*a* are exemplary rotational centers and exemplary support portions for the developing devices. When the support holes 48*a* are supported by the respective supporting projections 49*a*, the right sides of the respective developing devices Gy to Gk are rotatably supported with respect to the photoconductor units U5.

In FIG. 19, rightwardly projecting spring supporting portions 44*a* are formed at the right end wall 44 of the recording unit body 42 so as to be situated obliquely above the developing rollers G1*y* to G1*k*. The spring supporting portions 44*a* are exemplary supporting portions for biasing members. Coil springs 51 serving as exemplary biasing members connect the spring supporting portions 44*a* and the right ends of the respective developing rollers G1*y* to G1*k*, and bias the respective developing rollers G1*y* to G1*k* upwards.

Therefore, in the developing devices Gy to Gk in the first exemplary embodiment, the developing rollers G1*y* to G1*k* are supported by the respective pairs of left and right support holes 46*a* and 48*a* so as to be rotatable towards and away from the photoconductor members Py to Pk. By the elastic forces of the torsion springs 47 and the coil springs 51, related interval setting members that are publicly known and not illustrated, that is tracking members, are made to contact each other, so that the intervals between the developing rollers G1*y* to G1*k* and the photoconductor members Py to Pk are set to preset intervals. The tracking members are provided at the developing devices Gy to Gk and the photoconductor units U5. Here, play in the direction of a rotational axis is provided between the developing devices Gy to Gk (developing units U6) and the photoconductor units U5 so as to allow smooth rotation.

In FIGS. 8 to 10, a left securing portion 56 serving as a first support portion is formed at the lower back portion of the left end wall 43, that is, at the side of a discharge opening Rr1, so as to be situated below the backup roller T2*a*. The left securing portion 56 has a U-shaped left positioning groove 56*a* serving as an exemplary first positioning portion and extending from the lower back side to the upper front side. Left screw passage holes 56*b* and 56*c* that serve as exemplary first securing portions and that are capable of receiving screws are formed at respective sides of the left positioning groove 56*a* so as to be situated at the upper and lower sides of the left positioning groove 56*a*.

In FIG. 17, a right securing portion 57 having a structure that is similar to that of the left securing portion 56 and that serves as an exemplary second support portion is formed at the discharge-opening-Rr1 side, that is, the lower back portion of the right end wall 44. A right positioning groove 57*a* serving as an exemplary second positioning portion and right screw passage holes 57*b* and 57*c* serving as exemplary second securing portions are also formed at the lower back portion of the right end wall 44.

In FIGS. 8 and 9, a left fixing unit supporting portion 58 and a right fixing unit supporting portion 59 (forming a pair) are formed at the upper back portion of the respective end walls 43 and 44, that is, above the backup roller T2*a*.

In FIGS. 8, 9, 10, and 11A to 11C, the fixing unit supporting portions 58 and 59 include positioning securing portions 58*a* and 59*a*, respectively, projecting backwards from the back sides of the respective end walls 43 and 44. The positioning securing portions 58*a* and 59*a* have threaded holes 58*b* and 59*b*, respectively.

In FIGS. 8, 9, 10, and 11A to 11C, columnar fixing positioning portions 58*c* and 59*c* serving as exemplary third unit positioning portions are formed at the upper sides of the respective fixing unit supporting portions 58 and 59. Inclined surfaces 58*d* and 59*d* and positioning lower surfaces 58*e* and 59*e* are formed behind the respective fixing positioning portions 58*c* and 59*c*. The inclined surfaces 58*d* and 59*d* incline downward as they extend forward. The positioning lower surfaces 58*e* and 59*e* are formed below the respective fixing positioning portions 58*c* and 59*c*.

A high-voltage power supply supporting portion 61 serving as an exemplary first substrate supporting portion is supported at the front sides of the fixing unit supporting portions 58 and 59. The high-voltage power supply supporting portion 61 in the first exemplary embodiment has an accommodation space 61*a* that accommodates a circuit element used at a high-voltage power supply substrate.

A plate-like supporting portion 62 for a control substrate is formed at the front side of the high-voltage power supply supporting portion 61. The supporting portion 62 serves as an exemplary second substrate supporting portion. Forwardly projecting left and right front positioning portions 63 (forming a pair) are formed at the front end of the supporting portion 62 for a control substrate. The left and right front positioning portions 63 are exemplary third positioning portions. A front threaded hole 64 serving as a third securing portion is formed in the front surface of the recording unit body 42 so as to be disposed below the front positioning portions 63.

Therefore, the front positioning portions 63 and the front threaded hole 64 constitute the front securing portions 63 and 64 serving as third support portions in the first exemplary embodiment that are disposed opposite to, that is, at the front side of the discharge opening Rr1 of the image recording unit 41. The left securing portion 56, the right securing portion 57, and the front securing portions 63 and 64 constitute the recording unit support portions 56, 57, 63, and 64 in the first exemplary embodiment.

In FIG. 9, a driving unit 66 is supported by the left end wall 43 of the recording unit body 42. The driving unit 66 has a driving unit plate 66*a* serving as an exemplary opposing member and extending in the front-back direction and the up-down direction. A driving motor 67 is supported by the driving unit plate 66*a*. The driving motor 67 is an exemplary driving source and drives, for example, the driving roller Rd (that drives the photoconductor members Py to Pk and the intermediate transfer belt B) and the developing rollers G1*y* to G1*k* of the developing devices Gy to Gk. A transmission system (not shown) including, for example, gears and a clutch is supported by the driving unit plate 66*a*. The gears transmit driving force of the driving motor 67 to, for example, the photoconductor members Py to Pk. The clutch is used for controlling transmission and cutting off of the transmission of the rotation. A terminal-substrate supporting portion 68 having the form of a plate, extending in the up-down direction, and serving as an exemplary third substrate supporting portion is supported by a back portion of the driving unit 66.

In FIG. 10, a low-voltage power supply substrate 71 is supported by a right portion of the supporting portion 62 for a control substrate. The low-voltage power supply substrate 71 has electric power supplied thereto from a power supply disposed outside the printer U through a harness serving as a supply wire (not shown), and generates voltage supplied to, for example, a motor and a sensor. A control substrate 72 electrically connected to the low-voltage power supply substrate 71 and provided with circuits of, for example, the controller C and the image processing section GS is supported on the left of the low-voltage power supply substrate 71.

A high-voltage power supply substrate 73 is supported by the high-voltage power supply supporting portion 61. The high-voltage power supply substrate 73 generates, for example, a charging voltage applied to the charging rollers CRy to CRk, a developing voltage applied to the developing rollers G1*y* to G1*k*, and a first transfer voltage applied to the first transfer rollers T1*y* to T1*k*. Circuits provided on the lower-voltage power supply substrate 71 and the high-voltage power supply substrate 73 constitute the power supply circuit E in the first exemplary embodiment.

A terminal substrate 74 is supported by the supporting portion 68 for the terminal substrate. The terminal substrate 74 is electrically connected to the computer PC and has, for example, image information and control signals input thereto and output therefrom. An additional substrate 76 electrically connected to each of the substrates 71 to 74 is supported by the front side of the left surface of the driving unit 66.

A cooling fan 77 serving as an exemplary fan is supported above the driving motor 67.

The members 42 to 77 constitute the image recording unit 41 in the first exemplary embodiment.

Figure 20:
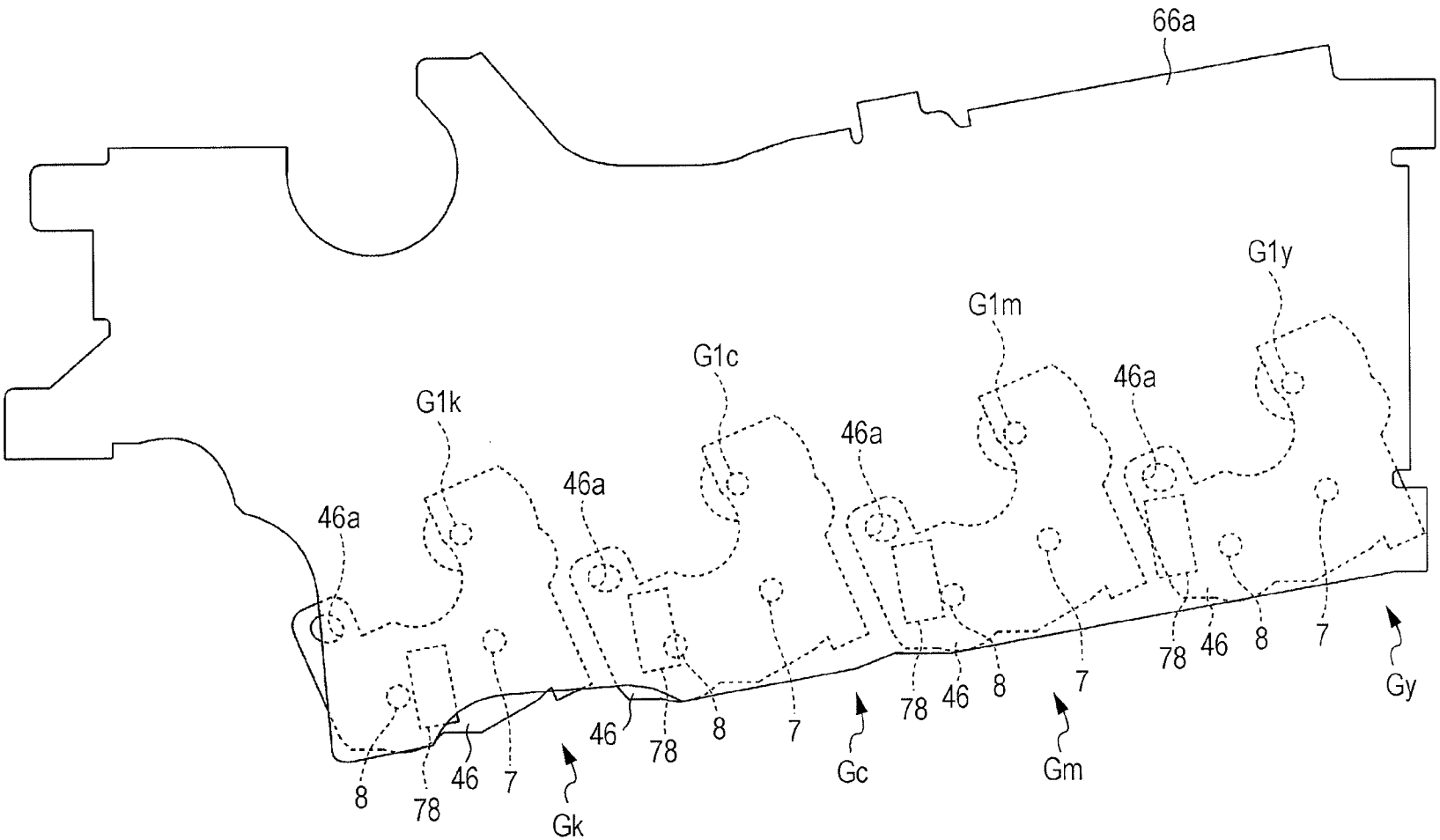
FIG. 20 is a left view illustrating left damping members according to the first exemplary embodiment.

FIG. 20 is a left view illustrating left damping members according to the first exemplary embodiment.

Figure 21:
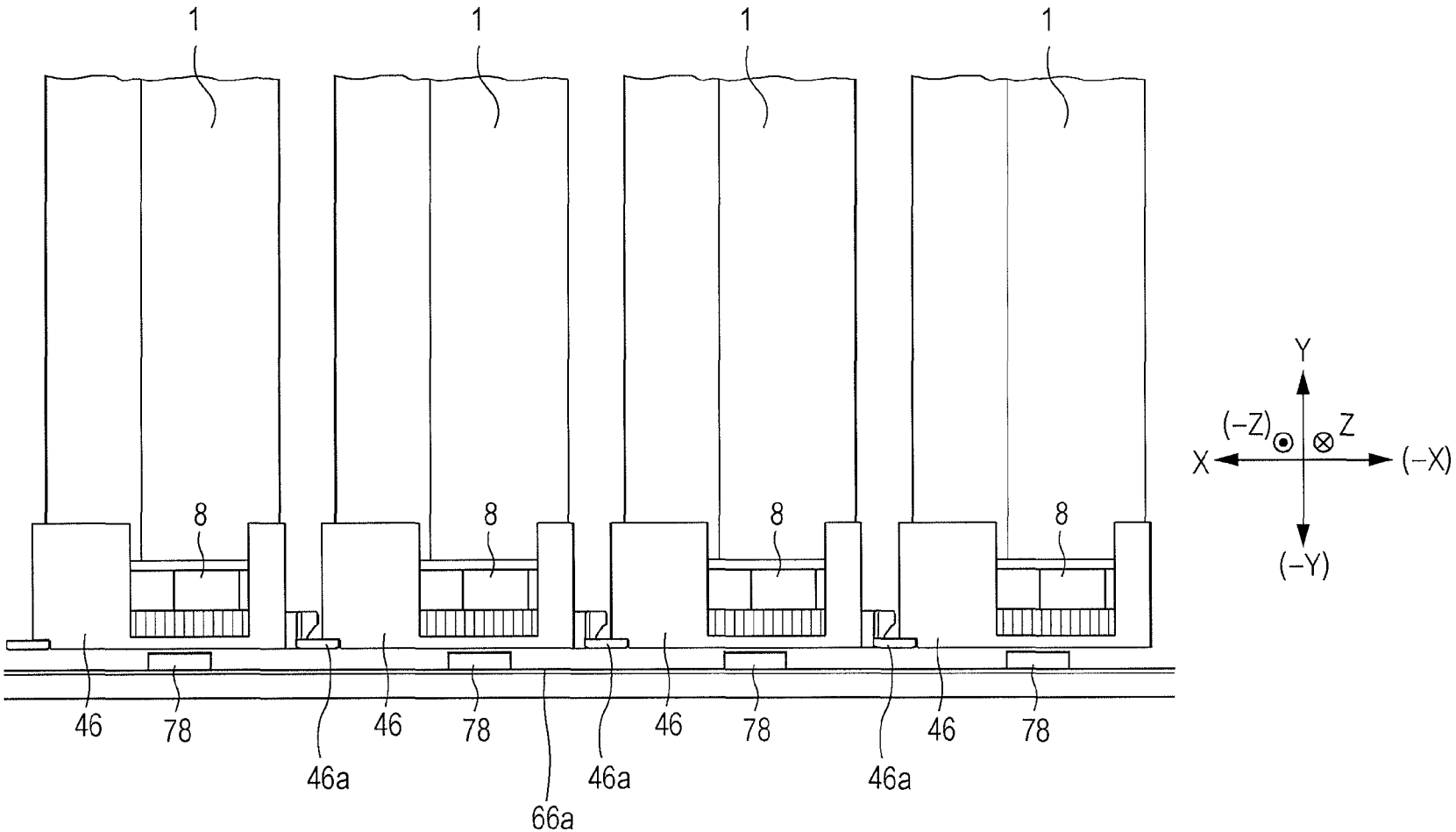
FIG. 21 illustrates the left damping members according to the first exemplary embodiment as seen from a lower side.

FIG. 21 illustrates the left damping members according to the first exemplary embodiment as seen from a lower side.

In FIGS. 20 and 21, damping sponges 78 serving as exemplary damping members are disposed between the protective covers 46 and the respective driving unit plates 66*a* in the first exemplary embodiment. The damping sponges 78 in the first exemplary embodiment are supported by the driving unit plate 66*a*, and are disposed so as not to contact the respective protective covers 46, that is, so as to be spaced apart from and close to the respective protective covers 46.

In FIG. 20, the damping sponges 78 in the first exemplary embodiment are disposed closer to the support holes 46*a* of the developing devices Gy to Gk than the developing rollers G1*y* to G1*k*, and obliquely below and at the front sides of the support holes 46*a*.

Description of Medium Transporting Unit

In FIGS. 12 and 13, a medium transporting unit 81 in the exemplary embodiment has a bottom wall 82. Left and right exterior-member securing portions 83 and 84 extending in the up-down direction and forming a pair are formed at the front end of the bottom wall 82. Lower securing threaded holes 83*a* and 84*a* for exterior-member securing are formed in the lower ends of the exterior-member securing portions 83 and 84. A left wall 86 and a right wall 87 extending backwards and constituting the left and right side walls of the feeding tray TR1 are formed behind the exterior-member securing portions 83 and 84.

Upwardly extending left and right recording unit securing portions 88 and 89 forming a pair and serving as exemplary first unit securing portions are formed at the back end of the bottom wall 82. A left positioning shaft 88*a* is formed at the left recording unit securing portion 88 serving as an exemplary first supporting portion. The left positioning shaft 88*a* serves as an exemplary first positioning member, is disposed in correspondence with the left positioning groove 56*a*, and projects leftwards. Left threaded holes 88*b* and 88*c* are formed in lower and upper sides of the left positioning shaft 88*a*. The left threaded holes 88*b* and 88*c* are exemplary first secure portions to be secured and are disposed in correspondence with the screw passage holes 56*b* and 56*c*. In FIG. 15, an upper back threaded hole 88*d* and a lower back threaded hole 88*d* forming a pair and serving as exemplary exterior-member securing portions are formed in the back surface of the recording unit securing portion 88.

The right recording unit securing portion 89 serving an exemplary second supporting portion has a structure that is similar to that of the left recording unit securing portion 88. Therefore, as shown in FIG. 17, a right positioning shaft 89*a* is also formed in the right recording unit securing portion 89. The right positioning shaft 89*a* is an exemplary second position member to be positioned, and is formed in correspondence with the right positioning groove 57*a*. In addition, right threaded holes 89*b* and 89*c* formed in correspondence with the screw passage holes 57*b* and 57*c* are also formed in the right recording unit securing portion 89. The right threaded holes 89*b* and 89*c* are exemplary second secure portions to be secured. As shown in FIG. 15, a pair of upper and lower back threaded holes 89*d* are formed in the back surface of the right recording unit securing portion 89.

In FIGS. 12 and 13, the registration rollers Rr are disposed near the positioning shafts 88*a* and 89*b* between the recording unit securing portions 88 and 89. A registration roller gear 91 having a clutch built therein is supported at the left ends of the registration rollers Rr. The registration roller gear 91 is an exemplary transmission gear to which a driving force is transmitted. The clutch is used for controlling transmission and cutting off of the transmission of the rotation. The feeding roller Rp is supported at the lower front side of the registration rollers Rr. A feeding roller gear 92 serving as an exemplary transmission gear is supported at the left end of the feeding roller Rp.

In FIG. 14, the registration roller gear 91 in the first exemplary embodiment is supported so as to allow transmission of the rotation through an intermediate gear 93 serving as an exemplary intermediate transmitting member rotatably supported at the left positioning shaft 88*a*. The intermediate gear 93 engages a gear 94 and a gear 95. The gear 94 is an exemplary first rotation transmitting member to which a driving force is transmitted from the driving motor 67 of the image recording unit 41. The gear 95 is an exemplary second transmitting member that is rotatably supported by the medium transporting unit 81 and that engages the registration roller gear 91. When the driving motor 67 is driven, the registration roller gear 91 is rotatable through the gears 93 to 95.

Left and right vertical guide members 96 and 97 are supported at the front surfaces of the exterior-member securing portions 83 and 84, respectively. The vertical guide members 96 and 97 form a pair, extend in the up-down direction, and are exemplary vertical guide members. The lower ends of the vertical guide members 96 and 97 in the first exemplary embodiment are supported at the upper surface of the bottom wall 82. Upper threaded holes 96*a* and 97*a* serving as exemplary exterior-member securing portions are formed in upper end portions of the vertical guide members 96 and 97, respectively.

A horizontal guide member 98 is supported below the upper threaded holes 96*a* and 97*a*. The horizontal guide member 98 is an exemplary third supporting portion, extends in the left-right direction, and connects the vertical guide members 96 and 97 to each other. A front threaded through hole 98*a* is formed in a central portion in the left-right direction of the horizontal guide member 98. The front threaded through hole 98*a* is an exemplary third secure portion to be secured and is formed in correspondence with the front threaded hole 64 of the image recording unit 41. A front positioning surface 98*b* is formed at the upper surface of the horizontal guide member 98. The front positioning surface 98*b* is an exemplary third position portion to be positioned with which the front positioning portions 63 contact.

An upper wall TR1*c* of the feeding tray TR1 is disposed above the bottom wall 82. The front end of the upper wall TR1*c* is supported by the vertical guide members 96 and 97.

A space surrounded by the bottom wall 82, the exterior-member securing portions 83 and 84, the vertical guide members 96 and 97, and the horizontal guide member 98 constitutes the replenishing opening TR1*d* of the feeding tray TR1.

In the medium transporting unit 81 in the first exemplary embodiment, the vertical guide members 96 and 97 and the horizontal guide member 98 constitute wire guiding members, that is, harness guides 96 to 98 that guide signal transmission wires and feeding wires (that is, harnesses) extending to the substrates 71 to 76 so as to route the harnesses around the replenishing opening TR1*d*.

Description of Fixing Unit

In FIG. 13, a fixing unit 101 serving as an exemplary third unit in the first exemplary embodiment has a fixing left wall 102 and a fixing right wall 103. The fixing device F and a discharge roller R1 are supported between the fixing left wall 102 and the fixing right wall 103.

In FIG. 13, a fixing connecting member 106 is supported at the lower end of the fixing left wall 102. The fixing connecting member 106 is an exemplary fixing support member to be supported and extends in the front-back direction. In FIGS. 11 and 13, a downwardly bent position securing portion 106*a* to be positioned is formed at the back end of the fixing connecting member 106. The position securing portion 106*a* is an exemplary fixing secure portion to be secured and is formed in correspondence with the positioning securing portion 58*a*. In FIG. 11, a back positioning hole 106*b* is formed in the fixing securing portion 106*a*. The positioning securing portions 58*a* and 59*a* are capable of extending through the back positioning holes 106*b* while they are fitted to the back positioning holes 106*b*.

In FIGS. 11 and 13, position portions 106*c* to be positioned are formed at the front end of the fixing connecting member 106. Each position portion 106*c* is an exemplary position portion for fixing, is forked, and sandwiches the fixing positioning portion 58*c* for performing positioning in the up-down direction.

As with the left fixing connecting member 106, a right fixing connecting member 106 is also formed at the lower end of the fixing right wall 103 in correspondence with the right fixing unit supporting portion 59.

Description of Exterior Members

In FIGS. 16 and 17, the printer U in the first exemplary embodiment is provided with a top cover 111, a front cover 112, and a rear cover 113 as exemplary exterior members. The top cover 111 covers the top portion of the printer U. The front cover 112 covers the front side of the printer U. The rear cover covers the rear side of the printer U.

In FIG. 17 the discharge tray TRh is formed at the front surface of the top cover 111. A pair of left and right upper secure portions 111*a* to be secured are formed at a front end portion of the top cover 111. The upper secure portions 111*a* are exemplary exterior-member secure portions (used for securing exterior members to the unit), are formed in correspondence with the vertical guide members 96 and 97, and extend downward. Threaded through holes 111*b* are formed at the respective upper secure portions 111*a* in correspondence with the upper threaded holes 96*a* and 97*a* of the vertical guide members 96 and 97.

In FIG. 17, a pair of left and right cover secure portions 111*c* to be secured are formed at a back end portion of the top cover 111. The left and right cover secure portions 111*c* are exemplary exterior-member secure portions used for securing the exterior members. A threaded hole (not shown) is formed in each cover secure portion 111*c*.

In FIG. 17, a pair of left and right semicircular positioning recesses 111*d* serving as exemplary exterior-member positioning portions are formed at a front end portion of the top cover 111. Three securing openings 111*e* are formed inwardly in the left-right direction of the positioning recesses 111*d*. The securing openings 111*e* are exemplary exterior-member securing portions, are square-shaped, and are spaced apart from each other in the left-right direction.

The front cover 112 has an opening 112*a* formed in correspondence with the replenishing opening TR1*d*. A pair of left and right screw passage holes 112*b* are formed below and at the left and right sides of the opening 112*a* in correspondence with the lower securing threaded holes 83*a* and 84*a* of the medium transporting unit 81. The screw passage holes 112*b* are exemplary exterior-member secure portions. In FIG. 17, a pair of left and right positioning projections 112*c* are formed at an upper end portion of the front cover 112 in correspondence with the positioning recesses 111*d*. The left and right positioning projections 112*c* are columnar projections and are exemplary exterior-member position portions to be secured. Securing pawls 112*d* are formed inwardly in the left-right direction of the positioning protrusions 112*c* in correspondence with the securing openings 111*e*. The securing pawls 112*d* are exemplary exterior-member secure portions.

The replenishing opening cover U2 is rotatably supported by the front cover 112.

An opening 113*a* for opening and closing a door is formed in a central portion of the rear cover 113. Four back screw passage holes 113*b* are formed, two at the left side of the opening 113*a* and two at the right side of the opening 113*a*, in correspondence with the four back threaded holes 88*d*. The back screw passage holes 113*b* are exemplary exterior-member secure portions. Cover securing portions 113*c* are formed at an upper end portion of the rear cover 113. The cover securing portions 113*c* are exemplary exterior-member securing portions and oppose the back surface of the cover secure portions 111*c*. Threaded through holes 113*d* are formed in the cover securing portions 113*c* in correspondence with the cover secure portions 111*c*.

An opening-closing door 114 serving as an exemplary opening-closing member is supported at the opening 113*a* of the rear cover 113. A lower end portion of the opening-closing door 114 is rotatably supported at the exterior-member securing portions 83 and 84 of the medium transporting unit 81. Guide members 116 at the back side of the medium transport path SH and at the second transfer roller T2*b* are supported at the inner surface of the opening-closing door 114.

Description of Cartridge Mounting/Removing Section

Figure 22:
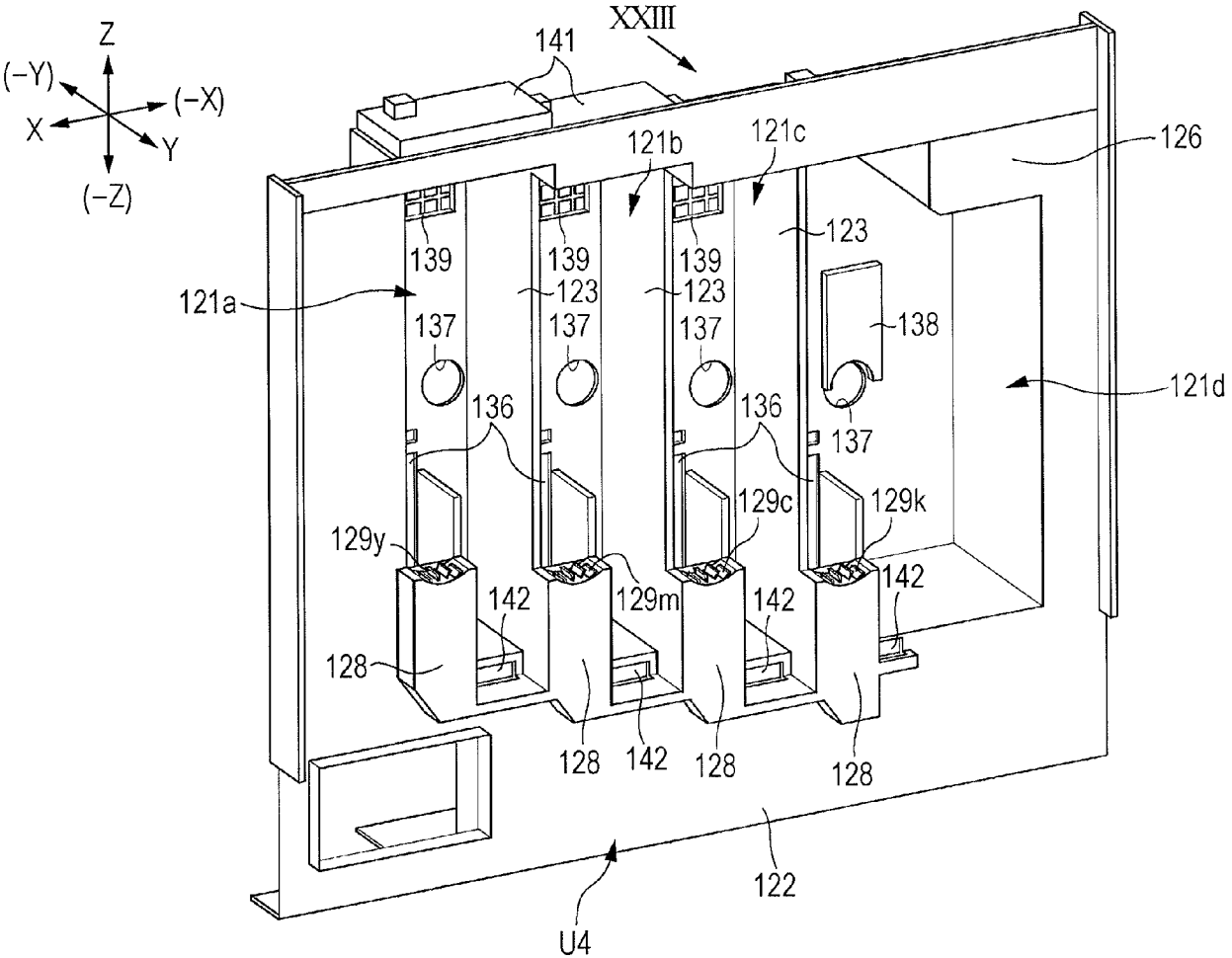
FIG. 22 illustrates a cartridge mounting/removing section according to the first exemplary embodiment.

FIG. 22 illustrates a cartridge mounting/removing section according to the first exemplary embodiment.

In FIGS. 1 to 3, a right cover 121 including the side cover U3 and serving as an exterior member is disposed on a right portion of the printer U in the first exemplary embodiment. The right cover 121 is secured and supported at the covers 111 to 113 by support portions (not shown). In FIGS. 3 and 22, the cartridge mounting/removing section U4 in the first exemplary embodiment disposed inwardly of the right cover 121 has a plate-like mounting/removing section body 122 serving as an exemplary opposing member. Four cartridge accommodating sections 121*a*, 121*b*, 121*c*, and 121*d* are formed at the mounting/removing section body 122 so as to be recessed towards the left in correspondence with the toner cartridges TCy to TCk that are mounted and removed. Partition walls 123 that extend in the up-down direction are formed between the cartridge accommodating sections 121*a* to 121*d*.

A projecting portion 126 is formed at an upper portion of the back end of the backmost K recessed portion 122*d* so as to project downward. The projecting portion 126 accommodates a lower front portion of the fixing device F.

Figure 23:
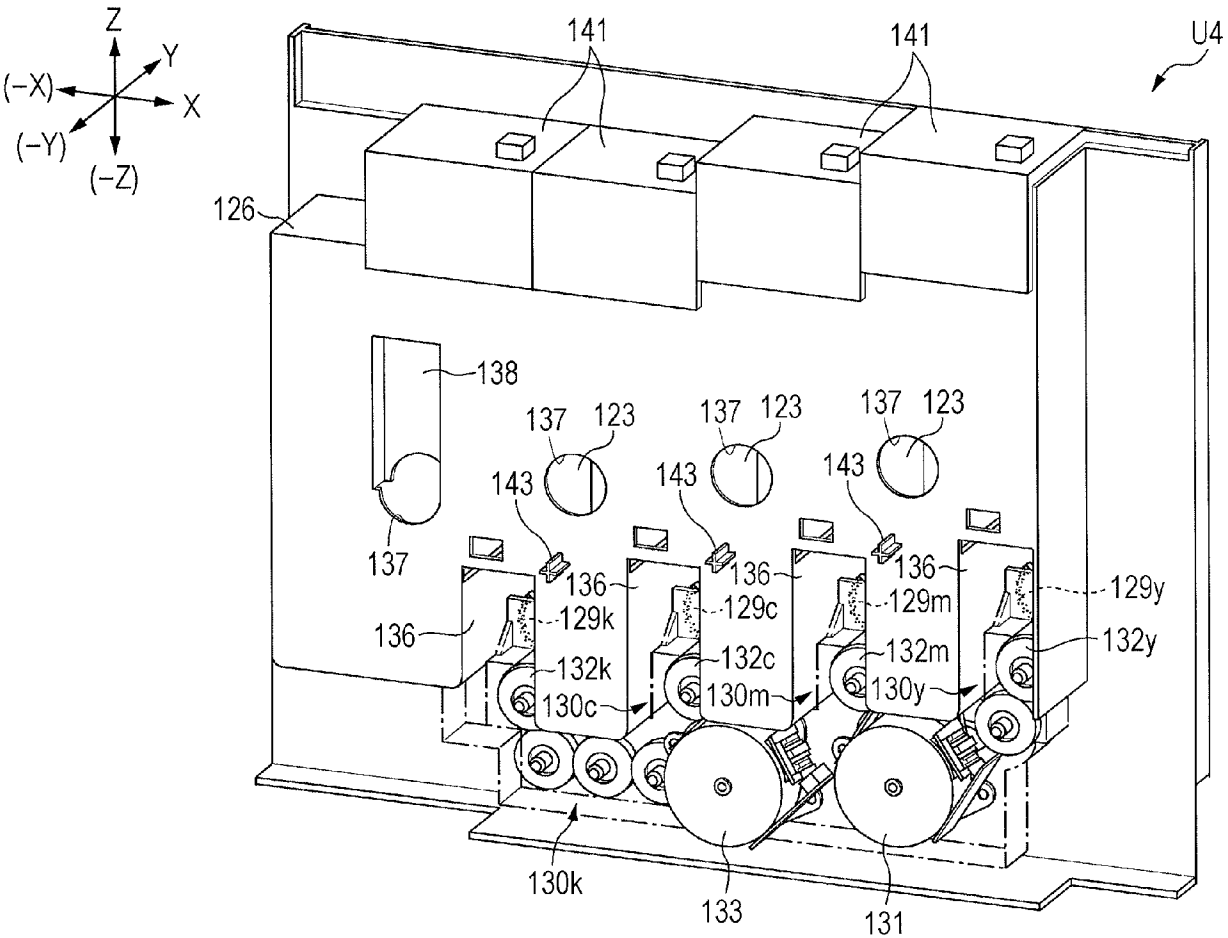
FIG. 23 shows the cartridge mounting/removing section as viewed from the direction of arrow XXIII in FIG. 22.

FIG. 23 shows the cartridge mounting/removing section as viewed from the direction of arrow XXIII in FIG. 22.

In FIGS. 22 and 23, transmission-system accommodating sections 123 are formed in the mounting/removing section body 122 so as to be situated at front-side lower end portions of the respective cartridge accommodating sections 122*a* to 122*d*. Transmission gears 129*y* to 129*k* are rotatably supported at the upper ends of the respective transmission-system accommodating sections 128. Upper portions of the transmission gears 129*y* to 129*k* are partly exposed in the respective cartridge accommodating sections 122*a* to 122*d*.

In FIG. 23, a driving force is transmitted to the transmission gear 129*y* for yellow from a first cartridge motor 131 through a gear train 130*y*. The gear train 130*y* is an exemplary transmission system including gears supported in the transmission-system accommodating section 128. The first cartridge motor 131 is an exemplary first driving device disposed at a lower portion of the left surface of the mounting/removing section body 112. The gear train 130*y* for yellow includes a one-way clutch 132*y* for yellow serving as an exemplary one-way transmission member that transmits rotation and that cuts off the transmission of the rotation by rotating idly.

As with the transmission gear 129*y*, a driving force is transmitted to the transmission gear 129*m* for magenta from the first cartridge motor 131 through a gear train 130*m* for magenta including a one-way clutch 132*m* for magenta.

In FIG. 23, a second cartridge motor 133 serving as an exemplary second driving device is supported behind the first cartridge motor 131. As with the transmission gear 129*y* and the transmission gear 129*m*, a driving force is transmitted to the transmission gear 129*c* for cyan and the transmission gear 129*k* for black from the second cartridge motor 133 through respective gear trains 130*c* and 130*k* having respective one-way clutches 132*c* and 132*k*.

Therefore, the transmission-system accommodating sections 128 function as accommodating sections that accommodate the structural members of the printer U including the transmission gears 129*y* to 129*k* and the gear trains 130*y* to 130*k*.

The cartridge motors 131 and 133 are capable of rotating in forward and reverse directions. By combining the directions of rotations of the cartridge motors 131 and 133 and the one-way clutches 132*y* to 132*k*, the respective transmission gears 129*y* to 129*k* are driven. For example, when the transmission gear 129*y* is to be rotated, the first cartridge motor 131 is rotationally driven in the forward direction, the rotation thereof is transmitted to the one-way clutch 132*y*, and the one-way clutch 132*m* rotates idly. This causes the transmission gear 129*y* to rotate and does not cause the transmission gear 129*m* to rotate. In contrast, if the transmission gear 129*m* is to be rotated, the first cartridge motor 131 is rotationally driven in the reverse direction, the clutch 132*y* is idly rotated, and the rotation is transmitted to the clutch 132*m*. This does not cause the transmission gear 129*y* to rotate, and causes the transmission gear 129*m* to rotate. This similarly applies to the transmission gear 129*c* and the transmission gear 129*k*. The clutches are not limited to one-way clutches. Similar functions achieved by using related driving transmission/driving transmission cut-off devices that are publicly known, such as electromagnetic clutches that are turned on and off in accordance with input signals.

In FIGS. 22 and 23, passage openings 136 for replenishing portions extending through the mounting/removing section body 122 in the left-right direction are formed on the left (that is, the side away from the viewer of the figures) of the transmission-system accommodating sections 128. The passage openings 136 are disposed in correspondence with the upper cylindrical portions 17 of the inlet shutters 13 of the developing devices Gy to Gk. Therefore, when the toner cartridges TCy to TCk are mounted, as shown in FIG. 3, replenishing portions TC1 of the toner cartridges TCy to TCk push the inlet shutters 13 backwards, so that the replenishing portions TC1 and the upper cylindrical portions 17 are connected while the inlets 12*c* for the replenishing developer are open. This causes the toner cartridges TCy to TCk to be connected so as to allow developers to be replenished from accommodating portions TC2 used for new developers and disposed at the upper portion of the toner cartridges TCy to TCk.

Circular passage openings 137 used for discharge portions and extending through the mounting/removing section body 122 in the left-right direction are formed above and behind the respective passage openings 136. As shown in FIG. 3, waste outlet shutters 26*c* and transport paths 26*a* for residual developer extend through the passage openings 137. When the toner cartridges TCy to TCk are mounted, waste inlets (not shown) of the toner cartridges TCy to TCk push the waste outlet shutters 26*c* backwards. As a result, the waste inlets and the transport paths 26*a* for residual developer are connected to each other so as to allow the developer to be discarded to waste developer accommodating portions TC3 at the lower portions of the respective toner cartridges TCy to TCk.

An accommodating portion 138 at a merging path is formed above the passage opening 137 for the discharge portion for black so as to protrude rightwards, that is, the side towards the viewer of the figures. The merging path 31, which is a structural member of the printer U, is accommodated at the inner side of the accommodating portion 138 at the merging path.

Body-side hardkeys 139 that have different forms depending upon the cartridge accommodating sections 122*a* to 122*c* for the respective colors are formed at top portions of the mounting/removing section body 122. The hardkeys 139 are used for identifying the ink colors of the respective toner cartridges TCy to TCc.

In FIGS. 22 and 23, a CRUM reader 141 is supported at the inner side of the upper end of the mounting/removing section body 122. The CRUM reader 141 is an exemplary information read-write device that reads and write by radio CRUM 131 serving as an exemplary information recording member supported by the toner cartridges TCy to TCk.

Pawl catching openings 142 are formed in the respective cartridge accommodating portions 122*a* to 122*d*. The pawl catching openings 142 are exemplary holding portions that hold the toner cartridges TCy to TCk in a mounted state. Pawl catching openings (not shown) that are similar to the pawl catching openings 142 are also formed above the pawl catching openings 142. Pawls TC4, which are formed at upper and lower ends of each of the toner cartridges TCy to TCk, are provided so as to be caught by the pawl catching openings 142. The pawls TC4 are exemplary hold portions to be held.

Figure 24:
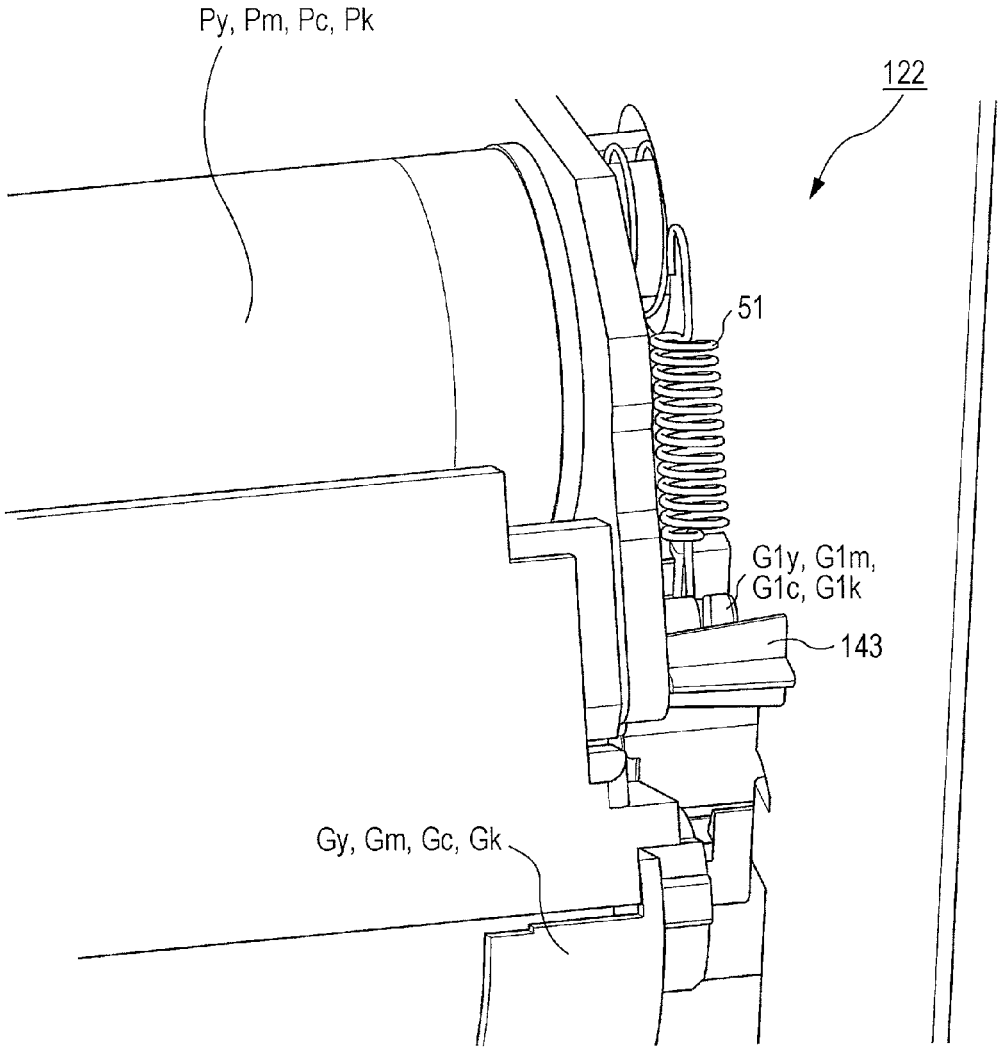
FIG. 24 illustrates the right side of a developing device and the right damping member.

FIG. 24 illustrates the right side of a developing device and a right damping member.

In FIGS. 23 and 24, damping ribs 143 are integrated to portions situated obliquely upward and forwardly of the respective cartridge accommodating portions 122*a* to 122*d*. The damping ribs 143 are exemplary damping members and protrude leftwards from the left surface of the mounting/removing section body 122. In FIG. 24, the damping ribs 143 in the first exemplary embodiment are not disposed at the right sides of the developing devices Gy to Gk. Instead, they are disposed in correspondence with the right walls 49 of the photoconductor units U5 that support the developing devices Gy to Gk. Ends of the damping ribs 143 are disposed close to the right walls 49 so as not to contact the right walls 49.

Description of Securing Each Unit and Member

Securing Image Recording Unit and Medium Transporting Unit

When the image recording unit 41 is supported by the medium transporting unit 81, as shown in FIGS. 12 to 14 and FIG. 17, the image recording unit 41 is positioned by fitting the positioning grooves 56*a* and 57*a* to the positioning shafts 88*a* and 89*a* and is supported so as to be rotatable around the positioning shafts 88*a* and 89*a*. The front positioning portions 63 of the image recording unit 41 are rotated until they contact the front positioning surface 98*b*, so that the front side of the image recording unit 41 is positioned. In this state, using screws that are passed through the left screw passage holes 56*b* and 56*c*, and that are fitted to the threaded holes 88*b* and 88*c*, the left back end of the image recording unit 41 is secured from the left. Similarly, using screws that are passed through the right screw passage holes 57*b* and 57*c*, and that are fitted to the threaded holes 89*b* and 89*c*, the right back end of the image recording unit 41 is secured from the right. Using a screw that is passed through the threaded through hole 98*a*, and that is fitted to the front threaded hole 64, the front end of the image recording unit 41 is secured from the front. That is, in the first exemplary embodiment, the left securing portion 56 and the right securing portion 57, and the front securing portions 63 and 64 (serving as third support portions to be supported) have fastening structures for fastening horizontally with respect to the image recording unit 41. Accordingly, the image recording unit 41 in the first exemplary embodiment is secured to the medium transporting unit 81 while being positioned at three locations, that is, the recording unit securing portions 88 and 89 and the horizontal guide member 98.

Therefore, the image recording unit 41 is unremovably supported by the medium transporting unit 81 from the viewpoint of a user who uses a medium (recording sheet S). "A user who uses a medium" refers to one who prints data, for example, at an office, in a shop, at an airport or hotel lounge, and at home; and does not refer to a service personnel who inspects and repairs an image forming apparatus when a defect occurs in the apparatus, or a worker who inspects and repairs in a factory or warehouse. Therefore, nonusers, such as a service personnel and a worker, is capable of disassembling the printer U using, for example, a tool, and remove the image recording unit 41 from the medium transporting unit 81.

The recording unit securing portions 88 and 89 and the horizontal guide member 98 constitute the recording unit supporting portions 88, 89, and 98 in the first exemplary embodiment.

Securing Image Recording Unit and Fixing Unit

When the fixing unit 101 is supported by the image recording unit 41, in FIGS. 11 and 13, the forked position portions 106*c* of the fixing unit 101 are guided to the respective inclined surfaces 58*d* and 59*d* and the respective positioning lower surfaces 58*e* and 59*e* of the image recording unit 41, and the position portions 106*c* are fitted to the respective fixing positioning portion 58*c* and 59*c*. Therefore, by fitting the position portions 106*d* and the respective fixing positioning portions 58*c* and 59*c*, respectively, the fixing unit 101 is supported by the image recording unit 41 so as to be movable in the front-back direction. Then, when the fixing unit 101 is moved until the positioning securing portions 58*a* and 59*a* are fitted to the back positioning holes 106*b* of the position securing portions 106*a* of the fixing unit 101, the fixing unit 101 is positioned. Thereafter, by securing the fixing unit 101 with the screws that are fitted to the threaded holes 58*b* and 59*c* of the respective fixing unit supporting portions 58 and 59, the fixing unit 101 is fixed to the image recording unit 41.

Securing Exterior Covers

In FIGS. 16 and 17, the front end of the top cover 111 is secured using the screws passing through the threaded through holes 111*b* of the respective upper secure portions 111*a* and fitted to the upper threaded holes 96*a* and 97*a* of the vertical guide members 96 and 97. The back end of the top cover 111 is secured to the rear cover 113 using the screws passing through the threaded through holes 113*d* of the cover securing portions 113*c* of the rear cover 113 and fitted to threaded holes (not shown) of the cover secure portions 111*c*.

While an upper edge of the front cover 112 is inserted within the inner side of a front edge of the top cover, the positioning projections 112*c* are fitted to and positioned by the positioning recesses 111*d*, and the securing pawls 112*d* are caught by the securing openings 111*e* of the top cover 111. Therefore, the front end of the top cover 111 is secured to the front cover 112. Then, a lower portion of the front cover 112 is secured to the medium transporting unit 81 using the screws passing through the screw passage holes 112*b* and fitted to the lower securing threaded holes 83*a* and 84*a* of the medium transporting unit 81.

The rear cover 113 is secured using screws passing through the back screw passage holes 113*b* and fitted to the back threaded holes 88*d* of the medium transporting unit 81.

Therefore, the top cover 111, the front cover 112, and the rear cover 113 are secured to the medium transporting unit 81 instead of to the image recording unit 41 and the fixing unit 101. A left side cover (not shown) in the first exemplary embodiment is supported by each of the covers 111 to 113 or the bottom wall 82.

Operation of First Exemplary Embodiment

In the printer U in the first exemplary embodiment having the above-described structure, the image recording unit 41 is secured to the image recording unit 41 while being directly positioned with respect to the image recording unit 41. In addition, the fixing unit 51 is secured to the image recording unit 41 while being positioned with respect to the image recording unit 41. That is, the medium transporting unit 81 and the fixing unit 51 are secured to the image recording unit 41 while being positioned with respect to the image recording unit 41. The printer U according to the first exemplary embodiment differs from a related, generally used printer having a frame. The printer U has a frameless structure. Therefore, the developing devices Gy to Gk are supported in the printer U so as to be unremovable.

The structure according to the first exemplary embodiment in which the developing devices Gy to Gk are unremovable differs from the related structure and technology, that is, the structure discussed in Japanese Unexamined Patent Application No. 2004-233492 (Patent Document 1) in which it is possible to remove and shake a removable developing device and from the technology discussed in Japanese Unexamined Patent Application No. 2010-191086 (Patent Document 2) in which the seal of a developing device is capable of being removed. The structure according to the first exemplary embodiment differs in that unless initial developers, that is, starter developers are initially contained in the developing containers 1 of the developing devices Gy to Gk in a manufacturing stage, it is difficult for a user to fill the developing containers 1 afterwards.

When the printer U is manufactured in a state in which the developers are contained in the developing containers 1, if, for example, the printer U is transported to a warehouse or is transported during shipment, the developers contained in the interiors of the developing containers 1 may become stiffened and may incline towards one side of the augers 7 and 8 in the axial direction. When the user starts using the printer U in this state, torque for driving the augers 7 and 8 becomes excessive, as a result of which, for example, a failure may occur in the driving motor 67 or the augers 7 and 8 may break. In order to unstiffen the stiffened developers in the developing devices Gy to Gk, or to move the inclined developers so that they are uniformly contained, it is possible to shake the entire printer U. However, it is very burdensome to a user to shake the entire printer U after it is set.

In contrast, in the first exemplary embodiment, the damping sponges 78 and the damping ribs 143 are disposed near ends of the developing devices Gy to Gk in the left-right direction, that is, ends of the augers in the axial direction. Therefore, if, the developing devices Gy to Gk that are movable in the left-right direction due to rattling in the rotational axis direction are vibrated due to, for example, transportation thereof, they contact either of the damping sponges 78 or the damping ribs 143, so that their vibrations are restrained and reduced. Therefore, compared to the case in which the damping members 78 and 143 are not provided, the vibrations of the developing devices Gy to Gk are reduced, the inclinations of the developers towards one side are reduced, the stiffening of the developers due to repeated inclinations of the developers towards one side is reduced, and the frequency with which the torque becomes excessive during the use of the printer U is reduced.

In the first exemplary embodiment, the damping sponges 78 and the damping ribs 143 are disposed so as to be spaced apart from the developing devices Gy to Gk. Therefore, when the printer U is set, ordinarily, the damping members 78 and 143 do not contact the developing devices Gy to Gk, so that they do not restrain the movements of the developing devices Gy to Gk. That is, compared to the case in which the damping members 78 and 143 contact the developing devices Gy to Gk, the rotational movements of the developing devices Gy to Gk are not restrained, so that they do not adversely affect tracking of the photoconductor members Py to Pk and the developing rollers G1*y* to G1*k*.

Further, in the first exemplary embodiment, the damping sponges 78 are disposed so as to be spaced apart from the developing rollers G1*y* to G1*k* and so as to be near the support holes 46*a* serving as the rotational centers of the respective developing devices Gy to Gk. Therefore, with the printer U being set, the developing devices Gy to Gk and the damping sponges 78 may contact each other due to, for example, manufacturing errors and tilting of a setting location of the printer U. However, compared to the case in which the damping sponges are disposed close to the developing rollers G1*y* to G1*k*, the frequency with which the damping sponges 78 adversely affect the tracking of the developing rollers G1*y* to G1*k* is reduced.

Second Exemplary Embodiment

Figure 25:
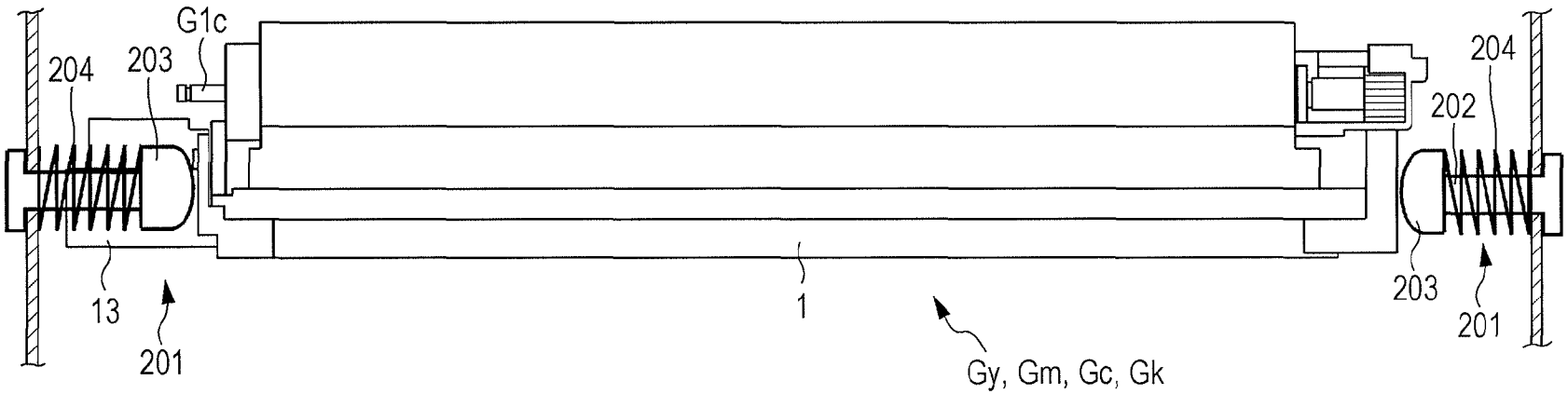
FIG. 25 illustrates damping members according to a second embodiment of the present invention.

FIG. 25 illustrates damping members according to a second exemplary embodiment of the present invention.

Next, the second exemplary embodiment of the present invention will be described. In the second exemplary embodiment, structural components corresponding to those of the first exemplary embodiment will be given the same reference numerals, and will not be described in detail below.

The second exemplary embodiment differs from the first exemplary embodiment with regard to the following points, and is the same with regard to the other points.

In FIG. 25, a printer U according to the second exemplary embodiment includes pairs of left and right cushions 201 (serving as exemplary damping members) instead of the damping sponges 78 and the damping ribs 143. Each cushion 201 includes a shaft 202, a contact portion 203, and a cushion spring 204. Each shaft 202 is supported so as to be movable in the left-right direction. Each contact portion 203 is supported by an end of the corresponding shaft 202 at the side of the corresponding one of the developing devices Gy to Gk, is disposed close to and without contacting the corresponding one of the developing devices Gy to Gk, and has a hemispherical contact surface. Each cushion spring 204 serves as an exemplary biasing member that biases the contact portion 203 towards the corresponding one of the developing devices Gy to Gk.

Operation of the Second Exemplary Embodiment

In the printer U according to the second exemplary embodiment having the above-described structure, when the developing devices Gy to Gk are vibrated, the developing devices Gy to Gk contact the respective cushions 201, so that their vibrations are attenuated and reduced due to the elasticity of the cushion springs 204 of the cushions 201. Therefore, the inclinations of developers towards one side are reduced as in the first exemplary embodiment.

Third Exemplary Embodiment

Figure 26:
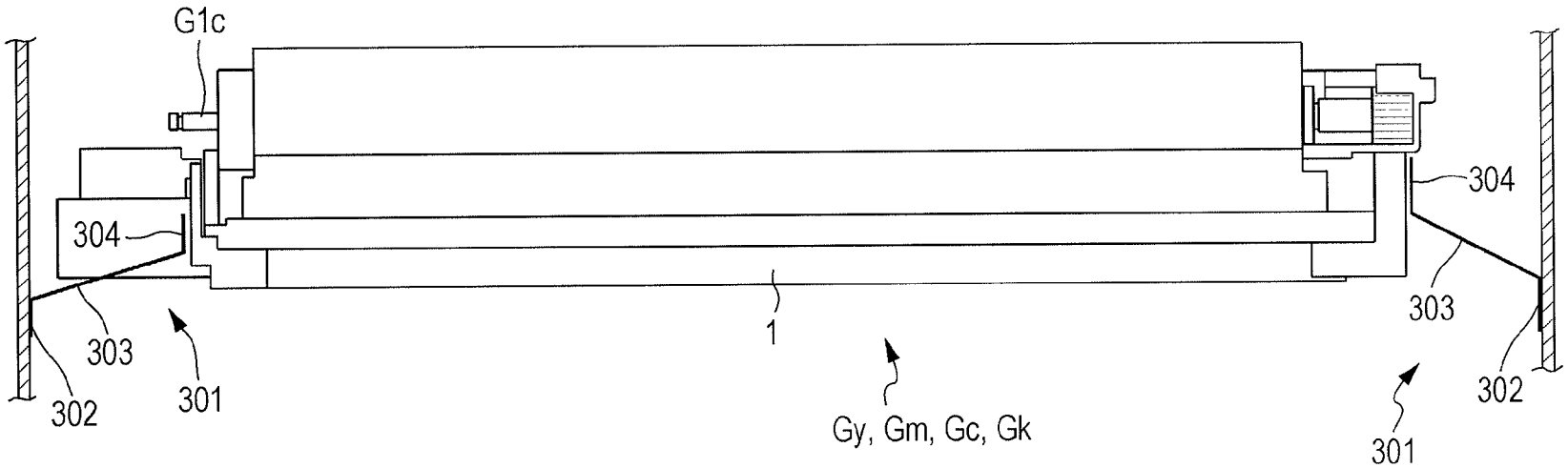
FIG. 26 illustrates damping members according to a third embodiment of the present invention.

FIG. 26 illustrates damping members according to a third exemplary embodiment of the present invention.

Next, the third exemplary embodiment of the present invention will be described. In the third exemplary embodiment, structural components corresponding to those of the first exemplary embodiment will be given the same reference numerals, and will not be described in detail below.

The third exemplary embodiment differs from the first exemplary embodiment with regard to the following points, and is the same with regard to the other points.

In FIG. 26, a printer U according to the third exemplary embodiment includes pairs of left and right leaf springs 301 (serving as exemplary damping members) instead of the damping sponges 78 and the damping ribs 143. Each leaf spring 301 includes a base end 302, a plate spring body 303, and a contact portion 304. Each base end 302 is secured to and supported by the driving unit plate 66*a* and the mounting/removing section body 122. Each plate spring body 303 extends from the corresponding base end 203 towards the corresponding one of the developing devices Gy to Gk. Each contact portion 304 is formed at an end of the corresponding plate spring body 303 and is disposed close to and without contacting the corresponding one of the developing devices Gy to Gk.

Operation of the Third Exemplary Embodiment

In the printer U according to the third exemplary embodiment having the above-described structure, when the developing devices Gy to Gk are vibrated, the developing devices Gy to Gk contact the respective contact portions 304, so that their vibrations are attenuated and reduced due to elastic deformation of the leaf springs 301. Therefore, the inclinations of developers towards one side are reduced as in the first exemplary embodiment.

Modifications

Although the exemplary embodiments of the present invention are described above in detail, the present invention is not limited to the above-described exemplary embodiments. Various modifications may be made within the scope of the gist of the present invention discussed in the claims. Modifications (H01) to (H09) of the present invention will be described below.

H01: Although, in the exemplary embodiments, a printer is used as an exemplary image forming apparatus, the present invention is not limited thereto. For example, a copying machine, a facsimile machine, or a multifunction device having more than one of the functions of or all of the functions of the copying machine and the facsimile machine may be used as the exemplary image forming apparatus.

H02: Although, in the exemplary embodiments, the printer U has a structure in which developers of four colors are used, the present invention is not limited thereto. For example, the printer U may be a monochromatic image forming apparatus or an image forming apparatus using a two or more colors, such as five or more colors or three of fewer colors.

H03: The structure including the image recording unit 41, the medium transporting unit 81, the covers 111 to 113, etc. is not limited to the structure exemplified in each of the exemplary embodiments. This structure may be optionally changed in accordance with, for example, design and specification. That is, although a frameless structure is exemplified, for example, a structure including a frame may also be optionally used.

H04: Although, in the exemplary embodiments, the damping sponges 78, the damping ribs 143, the cushions 201, and the leaf springs 301 are exemplified as damping members, the present invention is not limited thereto. For example, any structure that is capable of attenuating the vibration, such as elastic deformable rubber, may also be used. Alternatively, combinations of the damping members in the first to third exemplary embodiments may also be used. That is, for example, any combination is possible, such as the right side having the structure according to the second exemplary embodiment, and the left side having the structure according to the third exemplary embodiment.

H05: Although, in the exemplary embodiments, it is desirable for the damping members 78, 143, 201, and 301 not to contact the developing devices Gy to Gk, it is possible to use a structure in which they contact the developing devices Gy to Gk. In this case, in order to prevent the occurrence of a secondary failure, such as a tracking failure, it is possible to, for example, set the elasticity of the torsion springs 47 and the coil springs 51 to a high elasticity.

H06: Although, in the exemplary embodiments, it is desirable for the damping members 78, 143, 201, and 301 to be situated far away from the developing rollers G1*y* to G1*k*, the present invention is not limited thereto, so that they may be disposed close to the developing rollers G1*y* to G1*k*.

H07: Although, in the exemplary embodiments, the damping members 78, 201, and 301 are exemplified as being disposed directly at, opposing, and capable of contacting the developing devices Gy to Gk, the present invention is not limited thereto. Due to, for example, limited spaces for disposing the damping members, damping members, like the damping ribs 143, that indirectly restrain the vibrations through the photoconductor units U5 may also be used. Alternatively, the damping members may be those disposed at locations where the vibrations of the developing devices Gy to Gk are capable of being reduced through other members.

H08: Although, in the exemplary embodiments, the damping members 78, 143, 201, and 301 are exemplified as being provided at the driving unit plate 66*a* or at the mounting/removing section body 122 opposing the respective developing devices Gy to Gk, the present invention is not limited thereto. Either one of or both of the left and right damping members may be provided at the developing devices Gy to Gk.

H09: Although, in the exemplary embodiments, the members whose vibrations are restrained by the damping members 78, 143, 201, and 301 are exemplified as being the developing devices Gy to Gk, the present invention is not limited thereto. The present invention that is discussed with reference to the exemplary embodiments is applicable to a structure in which developers are contained in containers that are unremovable and that have rotating members disposed therein, such as a transport path of the developers.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image bearing member rotatably supported in a body of the image forming apparatus, the image bearing member bearing a developer image on a surface thereof;

a developing device including a developing container, a developing member, and a transporting member, the developing container containing a developer, the developing member disposed so as to oppose the image bearing member, the developing member having thereon the developer in the developing container and rotating to develop a latent image formed on the surface of the image bearing member, the transporting member transporting the developer in the developing container while stifling the developer, the developing device being supported with respect to the body of the image forming apparatus; and a damping member disposed with respect to an axial direction of a rotational axis of the developing member so as to be situated at an end portion of the developing container in the axial direction, the damping member restraining vibration of the developing container, wherein the damping member is disposed closer to a rotational center of the developing device than the developing member when viewed from the axial direction.

2. The image forming apparatus according to claim 1, comprising the developing container supported so as to be movable around the rotational center in directions in which the developing member moves towards and away from the image bearing member, and a biasing member that biases the developing container in a direction in which the developing member moves towards the image bearing member.

3. The image forming apparatus according to claim 2, comprising an opposing member disposed so as to oppose the end portion of the developing container in the axial direction, and the damping member supported by one of the developing container and the opposing member, and disposed so as to be spaced apart from the other one of the developing container and the opposing member.

4. The image forming apparatus according to claim 1, comprising an opposing member disposed so as to oppose the end portion of the developing container in the axial direction, and the damping member supported by one of the developing container and the opposing member, and disposed so as to be spaced apart from the other one of the developing container and the opposing member.

5. The image forming apparatus according to claim 1, wherein the damping member is unaligned from the image bearing member and the developing member in the axial direction.

6. An image forming apparatus comprising:

a developing device including a developing container, a developing member, and a transporting member, the developing container containing a developer, the developing member disposed so as to oppose an image bearing member, the developing member having thereon the developer in the developing container and rotating to develop a latent image formed on the surface of the image bearing member, the transporting member transporting the developer in the developing container while stirring the developer, the developing device being supported with respect to the body of the image forming apparatus; and a damping member disposed at an end portion of the developing device in a longitudinal direction, the damping member restraining vibration of the developing device, wherein the damping member is disposed closer to a rotational center of the developing device than the developing member when viewed from the longitudinal direction.

* * * * *